US007033201B2

(12) United States Patent
Ichida et al.

(10) Patent No.: US 7,033,201 B2
(45) Date of Patent: Apr. 25, 2006

(54) CONNECTOR LOCKING CONSTRUCTION

(75) Inventors: Kiyofumi Ichida, Yokkaichi (JP); Yukihiro Fukatsu, Yokkaichi (JP); Yukihiro Toyoda, Yokkaichi (JP); Yasushi Okayasu, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/005,338

(22) Filed: Dec. 6, 2004

(65) Prior Publication Data

US 2005/0082840 A1 Apr. 21, 2005

(30) Foreign Application Priority Data

May 12, 2003 (JP) ..... 2003-407596

(51) Int. Cl.
*H01R 13/627* (2006.01)

(52) U.S. Cl. ..... 439/352

(58) Field of Classification Search ..... 439/352, 439/358, 357, 354, 298, 832, 902, 904, 910, 439/923

See application file for complete search history.

(56) References Cited

U.S. PATENT DOCUMENTS

| | | | | |
|---|---|---|---|---|
| 2,000,318 | A * | 5/1935 | Cannon | 439/354 |
| 5,638,474 | A * | 6/1997 | Lampert et al. | 385/78 |
| 5,713,761 | A | 2/1998 | Okayasu | |
| 6,174,190 | B1 * | 1/2001 | Tharp et al. | 439/352 |
| 6,254,418 | B1 * | 7/2001 | Tharp et al. | 439/352 |
| 6,692,289 | B1 * | 2/2004 | Nemoto | 439/352 |
| 6,796,845 | B1 * | 9/2004 | Kuiken et al. | 439/668 |

* cited by examiner

*Primary Examiner*—Phuong Dinh
(74) *Attorney, Agent, or Firm*—Gerald E. Hespos; Anthony J. Casella

(57) ABSTRACT

A lock (35) is provided at the leading end of a resiliently deformable lock arm (33) on a female housing (20) and engages an engaging portion (14) on a male housing (10). An unlocking arm (40) is provided separate from the lock arm (33) and is resiliently inclinable like a seesaw. Projecting pieces (48) are formed on opposite surfaces of the lock (35) and unlocking pieces (49) on the unlocking arm (40) face the backsides of the projecting pieces (48). An operable portion (44) of the unlocking arm (40) is pressed to incline the unlocking arm (40) so that the unlocking pieces (49) lift the lock (35) of the lock arm (33), thereby canceling a locked state.

11 Claims, 31 Drawing Sheets

CONNECTOR LOCKING CONSTRUCTION

BACKGROUND OF THE INVENTION

1. Field of the Invention

The present invention relates to a connector locking construction.

2. Description of the Related Art

U.S. Pat. No. 5,713,761 and FIG. 36 herein disclose a locking construction for a connector. With reference to FIG. 36, the connector has a female housing 1 with a lock arm 2 that can undergo a seesaw-like resilient deformation. The connector also has a male housing 3 with an engaging portion 4 that is engageable with a lock 5 at the front end of the lock arm 2. An operable portion 6 is provided at the rear end of the lock arm 2. The lock 5 moves onto the engaging portion 4 at an intermediate stage of a connecting operation of the female and male housings 1, 3. Thus, the lock arm 2 resiliently inclines about a fulcrum 7. The lock 5 passes the engaging portion 4 when the housings 1, 3 are connected properly. Thus, the lock arm 2 returns to its initial position so that the lock 5 engages the rear surface of the engaging portion 4. As a result, the housings 1, 3 are locked together. The operable portion 6 can be pressed in this locked state to incline the lock arm 2 in a manner to bring the front side of the lock arm 2 up. Accordingly, the lock 5 disengages from the engaging portion 4 so that the housings 1, 3 can be separated.

The fulcrum 7 of the lock arm 2 can be thickened to increase the rigidity of the fulcrum 7 and to increase the locking strength of the connector. However, a larger force then is required to forcibly incline the lock arm 2 for canceling the locked state. Conversely, efforts to reduce the unlocking force result in a poor locking strength. Thus, there have been competing demands to increase in the locking strength and reduce the unlocking force.

The lock 5 engages the rear surface of the engaging portion 4 when the lock arm 2 is restored resiliently in the locked state. A lock feeling is generated at this time by letting the lock 5 make a hitting sound or a clicking feeling upon hitting a part of the mating male housing 3 immediately after the engaging portion 4. However, restoration of the seesaw-shaped lock arm 2 sometimes is canceled when a finger or another part contacts the rear end of the lock arm 2 near the operable portion 6. Thus, a sufficient lock feeling often is not generated.

The present invention was developed in view of the above problem and an object thereof is to realize both an increase in a locking strength and a reduction in an unlocking force and additionally to stabilize a lock feeling.

SUMMARY OF THE INVENTION

The invention relates to a connector locking construction for first and second housings that are mateable with one another. The locking construction has an engaging portion on the first housing and a lock arm on the second housing. A lock is at the leading end of the lock arm and is engageable with the engaging portion. The lock arm is resiliently inclinable with a base end thereof as a support. An unlocking arm is provided on the second housing separate from the lock arm and is resiliently inclinable like a seesaw. An unlocking portion is formed at a leading end of the unlocking arm and faces the back of the leading end of the lock arm. An operable portion is provided at the rear end of the unlocking arm. The operable portion can be pressed to incline the unlocking arm and to lift the leading end of the locking arm. Thus, the lock can be disengaged from the engaging portion.

The lock moves over the engaging portion as the two housings are connected and only the lock arm is resiliently inclined with the base end thereof as a support. The unlocking arm remains at its initial position. The lock passes the engaging portion when the two housings are connected properly and the lock arm is restored to its initial posture. Thus, the lock engages the rear surface of the engaging portion. In this way, the housings are locked in their properly connected state.

The operable portion at the rear end of the unlocking arm is pressed to separate the housings. Thus, the unlocking arm tilts and lifts the leading end of the unlocking arm. As a result, the unlocking portion pushes the leading end of the lock arm up to disengage the lock from the rear surface of the engaging portion. As a result, the locked state is canceled.

The leading end of the lock arm and the leading end of the unlocking arm may extend forward with respect to a connecting direction with the first housing. The front end of the unlocking arm may be formed into a frame to surround the leading end of the lock arm. The unlocking portion then is formed on each of left and right frame pieces of the unlocking arm and is engageable with the back surface of the corresponding one of the left and right edges of the leading end of the lock arm. With this construction, a position very close to the leading end of the lock arm can be pushed up. Therefore, the unlocking can be effected with an even smaller force.

In an alternate design, the leading end of the lock arm is formed into a frame that surrounds the one end of the unlocking arm. The unlocking portion is formed on each of the left and right edges of the unlocking arm for engaging the back surface of corresponding frame pieces at the leading end of the lock arm. With this construction, the lock can be wider than the lock arm. Thus, a large area of engagement can be ensured with the engaging portion of the mating housing to enhance the locking strength.

The locking end of the lock arm may extend back with respect to a connecting direction with the first housing, and the unlocking end of the unlocking arm may extend forward with respect to the connecting direction with the mating housing for abutment against the locking end of the lock arm. Thus, the lock arm can successively move onto the engaging portion of the first housing from the base end towards the leading end as the two housings are connected. Thus, a counteracting force from the lock arm gradually decreases as the connection progresses, and the connecting operation can be carried out smoothly with less feeling of resistance.

As described above, the unlocking arm is an inclinable seesaw separate from the lock arm and the lock of the lock arm is pushed up to cancel the locked state by utilizing the lever action of the unlocking arm. Thus, unlocking is carried out smoothly and securely while increasing the locking force by thickening the base end of the lock arm to enhance the rigidity thereof. A fulcrum of the unlocking arm can be narrowed to a necessary and minimum extent so that the unlocking arm can be inclined with a small force. Accordingly, both an increase in the locking strength and a reduction in the unlocking force can be realized.

The leading ends of the lock arm and the unlocking arm could be integral. However, this unlocking arm would function to pull the lock arm if the lock arm tries to return upon proper connection of the housings. This would reduce a force of the lock to hit the upper surface of the mating housing. Therefore a hitting sound may be softer and the lock feeling may be poor.

In contrast, the leading end of the lock arm and the one end of the unlocking arm are separate according to the present invention. Thus, only the lock arm is inclined as the two housings are connected, and only the lock arm returns when the two housings are properly connected. Therefore, the lock can hit the upper surface of the mating connector housing with force, thereby giving a loud hitting source and a secure clicking feeling.

The lock arm is cantilevered. Thus, a reduction in a returning force of the lock arm due to contact of a finger or other part with an end of the lock arm opposite the lock is avoided. This also contributes to a stable lock feeling.

DETAILED DESCRIPTION OF THE PREFERRED EMBODIMENTS

Figure 1:
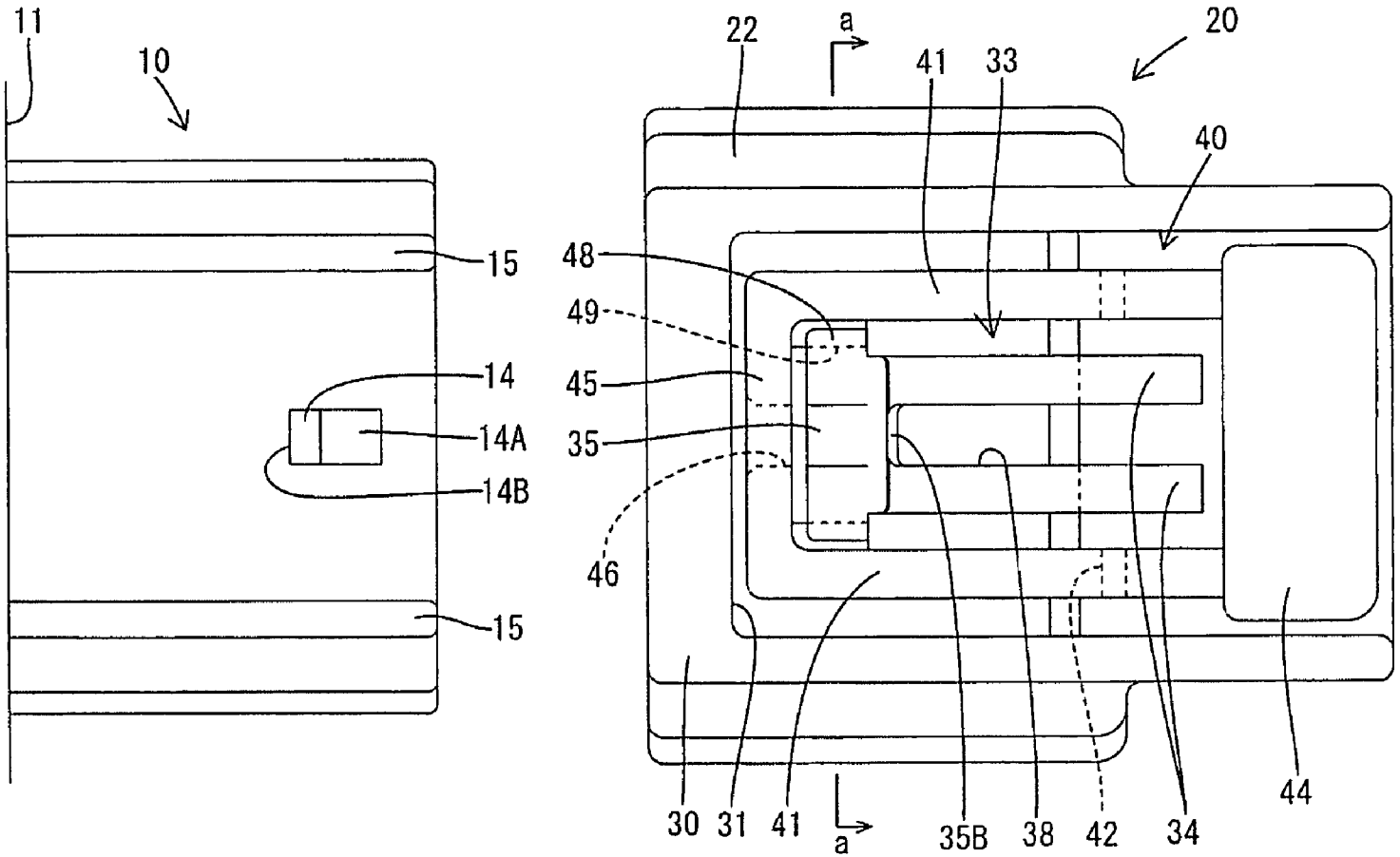
FIG. 1 is a plan view showing a state where male and female housings according to a first embodiment of the invention are connected.
Figure 2:
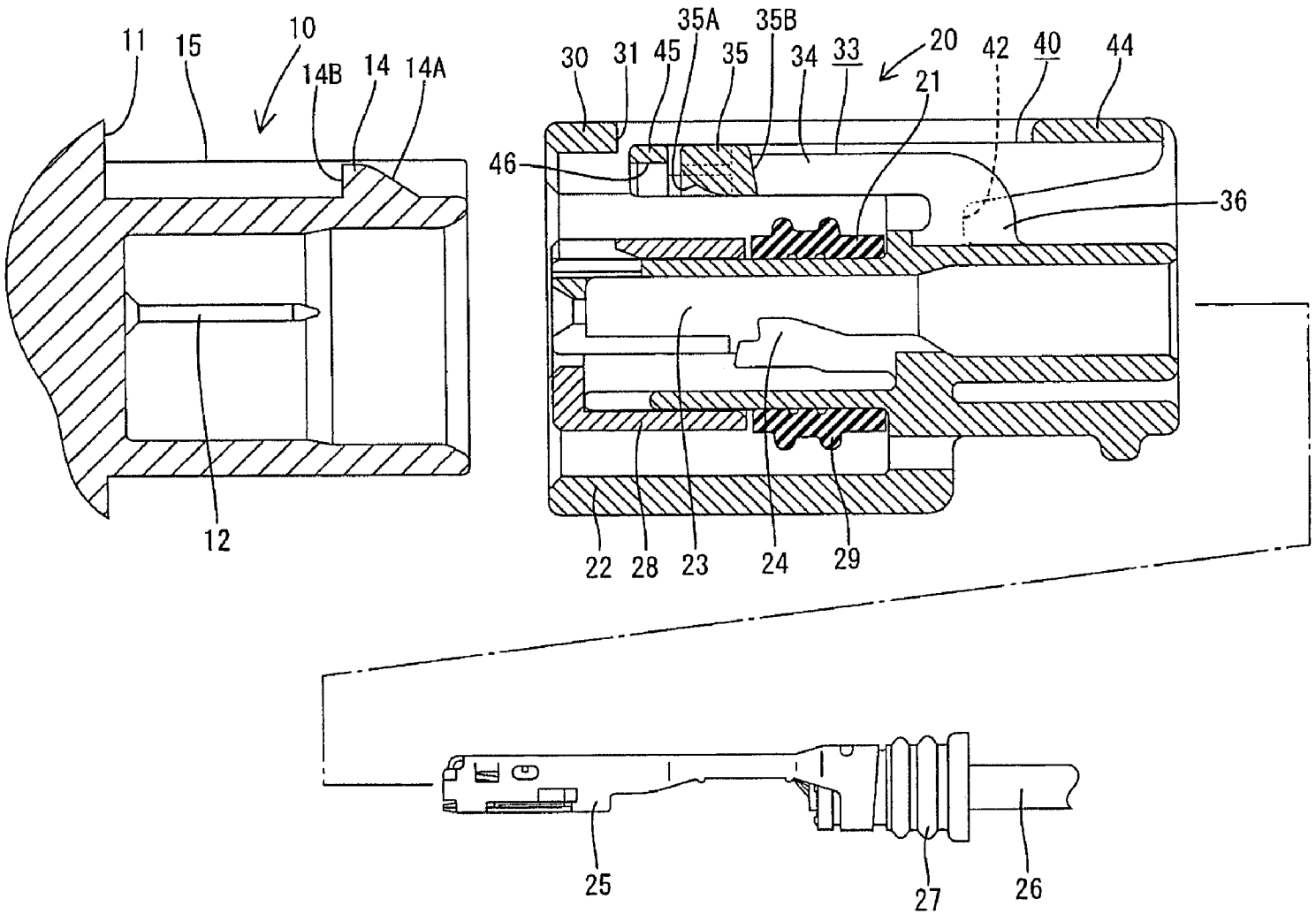
FIG. 2 is a longitudinal section showing the state of FIG. 1.

A first embodiment of a connector according to the invention is described with reference to FIGS. 1 to 12. The connector is comprised of a male housing 10 and a female housing 20 connectable with each other, as shown in FIGS. 1 and 2. In the following description, ends of the respective housings 10, 20 to be connected are referred to as the front.

Figure 3:
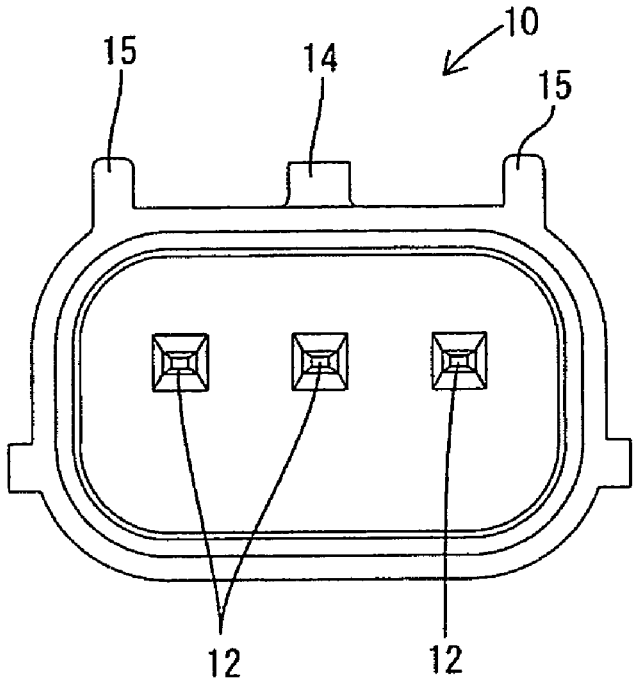
FIG. 3 is a front view of the male housing.
Figure 4:
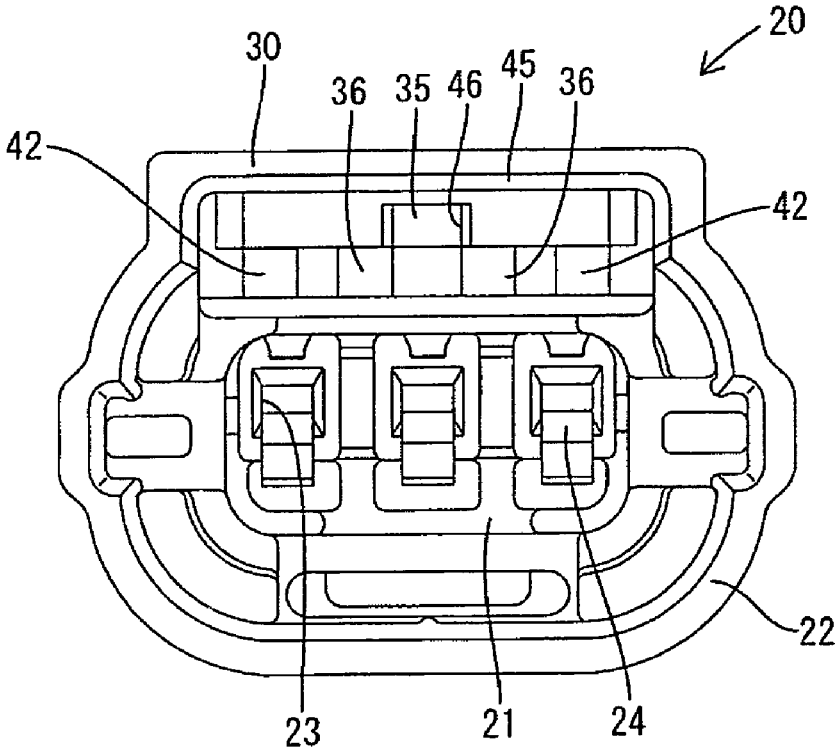
FIG. 4 is a front view of the female housing.
Figure 5:
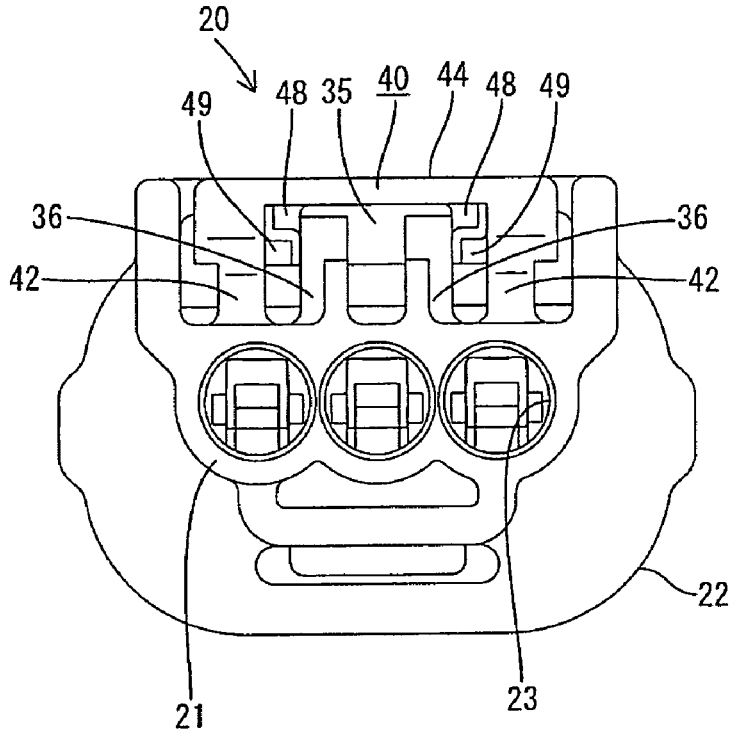
FIG. 5 is a rear view of the female housing.

The male housing 10 is coupled directly to an apparatus and is a wide tube that projects integrally from an outer wall of an apparatus main body 11 made of a synthetic resin, as shown in FIG. 3. Three tab-shaped male terminals 12 project side-by-side at specified intervals along a transverse direction from the back surface of the male housing 10.

An engaging portion 14 projects from the widthwise center of the upper surface of the male housing 10 close to the front end. A slanted guiding surface 14A is defined at the front of the engaging portion 14 and a vertical engaging surface 14B is defined at the rear surface thereof.

Guide walls 15 are formed at the opposite sides of the engaging portion 14 on the upper surface of the male housing 10.

The female housing 20 also is made of a synthetic resin and has a wide block-shaped terminal accommodating portion 21 and a receptacle 22 formed around a front side of the terminal accommodating portion 21. The terminal accommodating portion 21 fits into the mating male housing 10, and the receptacle 22 fits around the male housing 10. Three side-by-side cavities 23 are formed in the terminal accommodating portion 21 and extend forward and backward at the same intervals as the male terminals 12. A lock 24 is formed at the bottom surface of each cavity 23.

Figure 8:
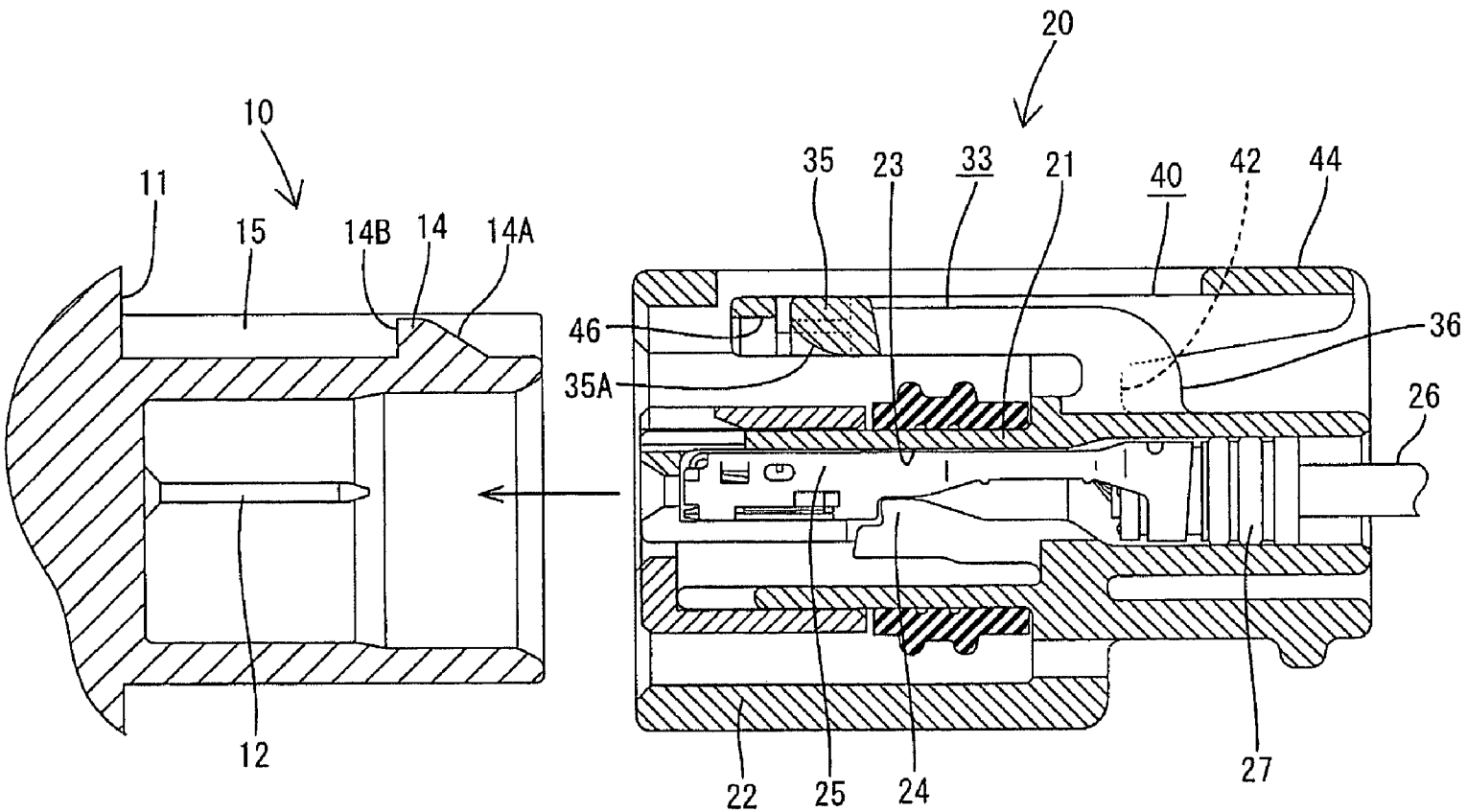
FIG. 8 is a longitudinal section showing a connecting operation of the two housings.

Female terminals 25 are secured respectively to ends of wires 26 and to waterproof rubber plugs 27. The female terminals 25 then are inserted into the cavities 23 from behind for connection with corresponding male terminals 12. The female terminal 25 deforms the lock 24 during insertion into the cavities 23. The lock 24 then is restored resiliently and partly locks the female terminal 25, as shown in FIG. 8. Although no detailed construction is described here, the female terminal 25 is locked doubly by a front-type retainer 25 mounted on the front surface of the terminal accommodating portion 21. The retainer 28 also retains a seal ring 29 on the outer surface of a base end of the terminal accommodating portion 21 to provide sealing between the two housings 10, 20.

The upper surface of the receptacle 22 of the female housing 20 is elevated slightly to form an arch 30. A window 31 is formed in the upper surface of the arch 30 except the front part thereof. The window 31 extends to the rear surface of the terminal accommodating portion 21 and has an open rear end in the upper surface of the arch 30 except the front part thereof.

A lock arm 33 is provided in the window 31. The lock arm 33 has two substantially parallel arms 34 that cantilever forward and a lock 35 that couples leading ends of the arms 34. The arms 34 are larger at the back side and have thick base ends 36 that stand up integrally from the upper surface of the terminal accommodating portion 21 substantially at the rear surface of the receptacle 22. The arms 34 extend to a position before the front edge of the window 31 by a specified distance and are parallel at a spacing slightly larger than the width of the engaging portion 14 of the male housing 10. The lock 35 crosses the extending ends of the arms 34 to couple the extending ends. A rounded guiding surface 35A is at the bottom end of the front of the lock 35.

The lock arm 33 can be inclined resiliently up and down with the base ends 36 as supports to lift a front side thereof. A locking groove 38 is formed between the arms 34 for receiving the engaging portion 14 of the male housing 10. A locking surface 35B is defined at the front of the locking groove 38 to face the engaging surface 14B of the engaging portion 14.

Figure 6:
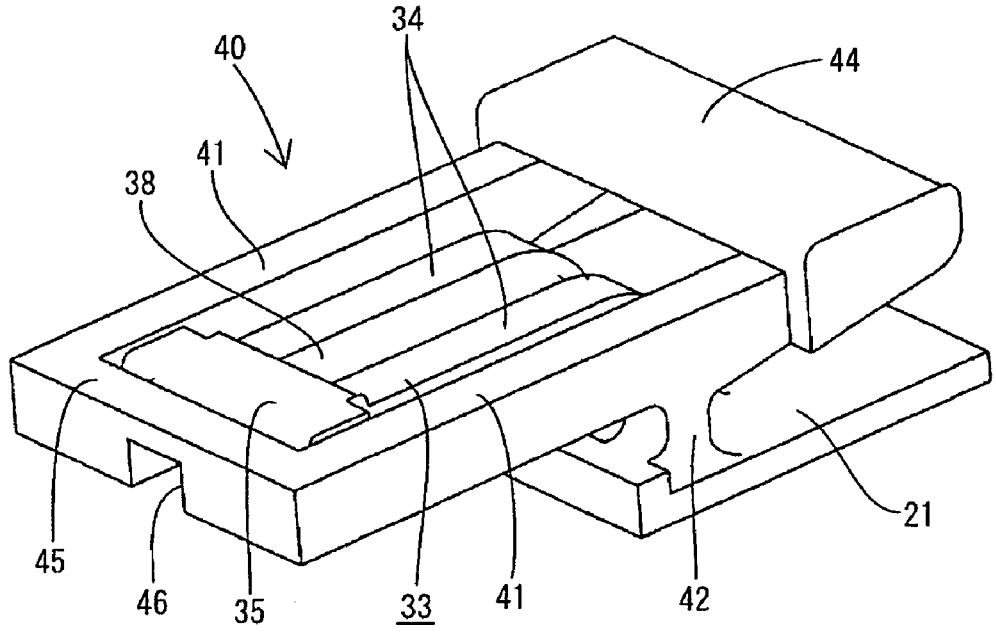
FIG. 6 is a perspective view of a locking mechanism of the female housing.

An unlocking arm 40 is provided separately from the lock arm 33 in the window 31 of the female housing 20 for canceling the locking by the lock arm 33. The unlocking arm 40, as shown in FIG. 6, is a rectangular frame that surrounds the lock arm 33. Left and right frame pieces 41 are spaced apart to fit inside the guiding walls 15 of the male housing 10, and fulcrums 42 couple the bottom surfaces of the left and right frame pieces 41 integrally to the upper surface of the terminal accommodating portion 21 via fulcrums 42. The fulcrums 42 are thinner than the base ends 36 of the lock arm 33, and align with the front halves of the base ends 36 of the lock arm 33.

A rear frame piece of the unlocking arm 40 is a wide plate and has an operable portion 44 that can be pressed by a finger or the like. A front frame piece 45 connects the front ends of the left and right frame pieces 41, and an escaping groove 46 is formed in the widthwise center of the lower surface of a front frame piece 45 for receiving the engaging portion 14 of the male housing 10. The operable portion 44 can be pressed down. As a result, the unlocking arm 40 inclines resiliently with the fulcrums 42 as a supporting point to lift the front frame piece 45.

Figure 7:
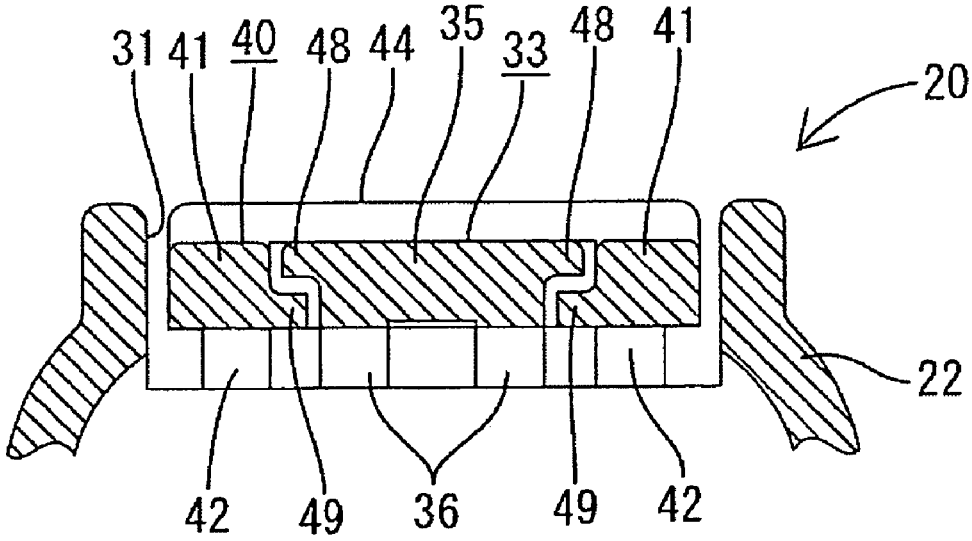
FIG. 7 is a section along a—a of FIG. 1.

Projecting pieces 48 are formed on the left and right surfaces of the lock 35 at the leading end of the lock arm 33 and bulge out in substantially upper half areas along a thickness direction, as shown in FIG. 7.

Unlocking pieces 49 are formed on the inner surfaces of the left and right frame pieces 41 of the unlocking arm 40 facing the projecting pieces 49 and bulge out in substantially lower half areas along the thickness direction. The unlocking pieces 49 slip under the corresponding projecting pieces 48.

Figure 9:
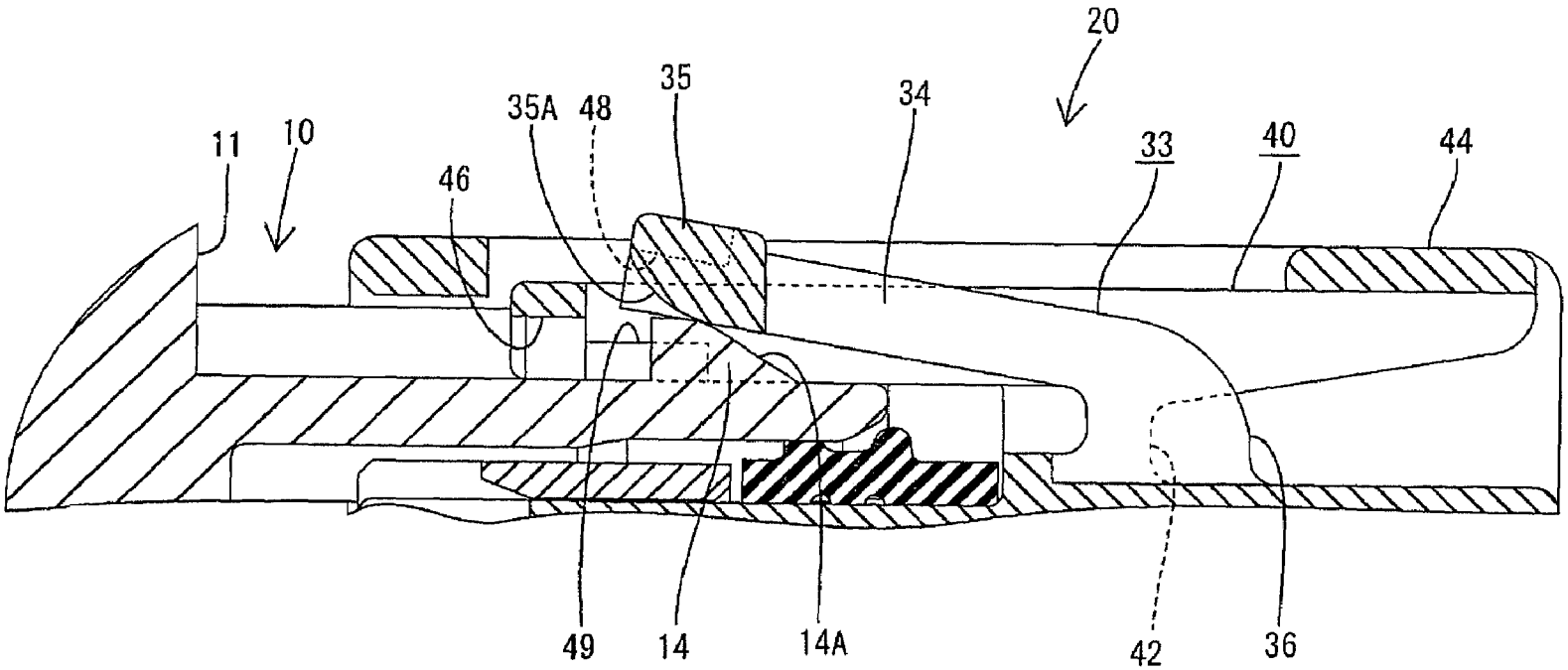
FIG. 9 is a partial longitudinal section showing an intermediate stage of connection.

The female terminals 25 are mounted into the female housing 20, and then the female housing 20 is connected with the male housing 10 as shown by the arrow in FIG. 8. The female housing 20 is connected to move the unlocking arm 40 along the inner sides of the two guiding walls 15. Thus, the engaging portion 14 enters through the escaping groove 46 of the unlocking arm 40 and the guiding surface 14A contacts the guiding surface 35A of the lock 35 of the lock arm 33. As a result, the lock 35 moves onto the engaging portion 14 and the lock arm 33 inclines resiliently with the base ends 36 as a support as shown in FIG. 9. The projecting pieces 48 escape up from the unlocking pieces 49 as the lock arm 33 is inclined, but the unlocking arm 40 remains at its initial position.

Figure 10:
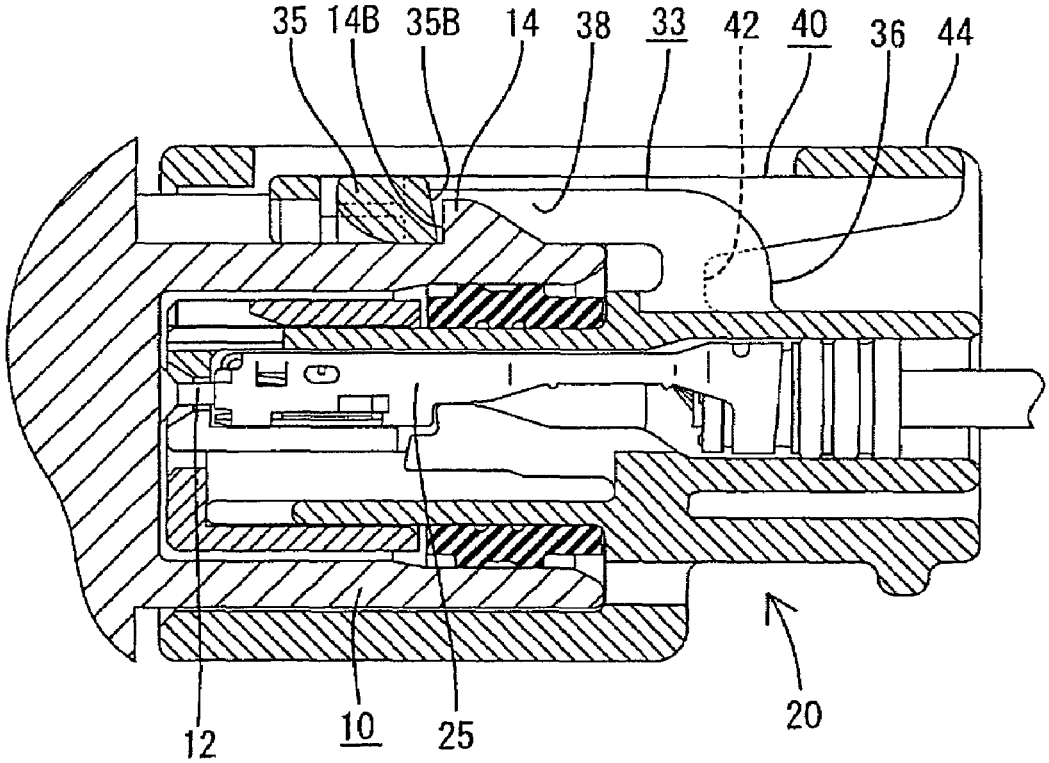
FIG. 10 is a longitudinal section showing complete connection.
Figure 11:
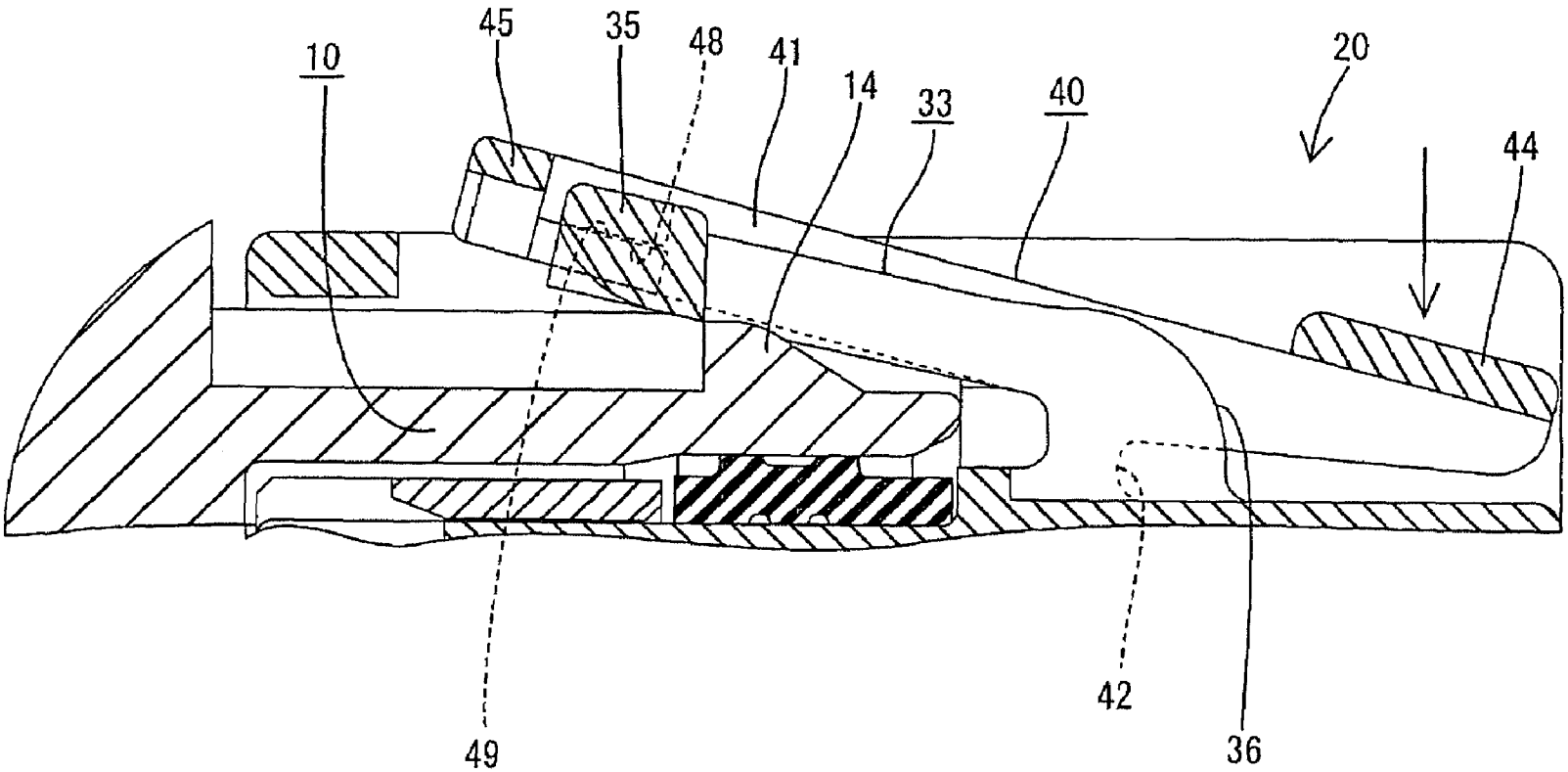
FIG. 11 is a partial longitudinal section showing a state where an unlocking arm is pressed.

The lock 35 passes the engaging portion 14 when the female housing 20 is connected to a proper position. Thus, the engaging portion 14 fits into the locking groove 38 and the engaging surface 14B engages the locking surface 35B, as shown in FIG. 10. The lock arm 33 then is restored to its initial posture, and the two housings 10, 20 are locked in their properly connected state.

Figure 12:
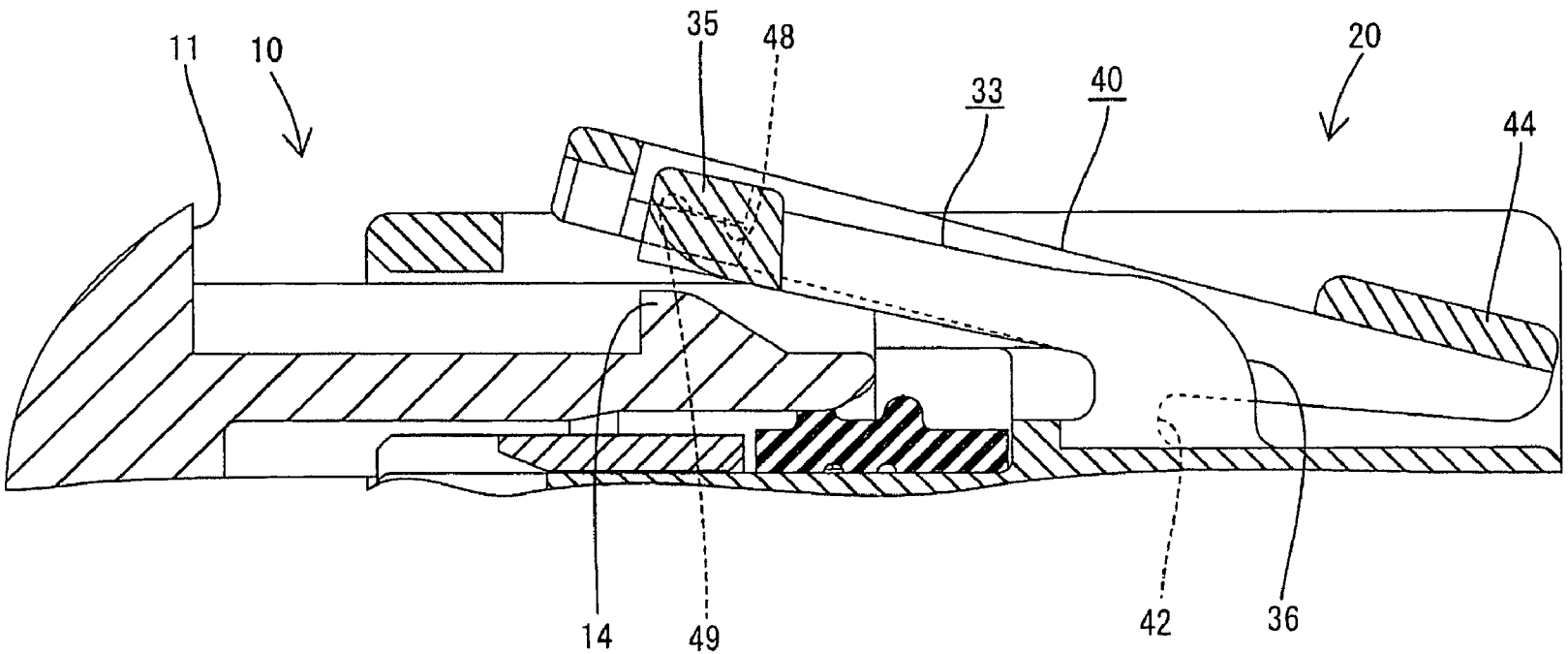
FIG. 12 is a partial longitudinal section showing an intermediate stage of separation.

The housings 10, 20 may have to be separated. Thus, the operable portion 44 of the unlocking arm 40 is pressed as shown by the arrow in FIG. 11 from a state shown in FIG. 10, and the unlocking arm 40 inclines to lift the front frame piece 45. Thus, the unlocking pieces 49 push the projecting pieces 48 up to move the lock 35 of the lock arm 33 up and disengage the lock 35 from the engaging portion 14. The female housing 20 then is pulled back and out of the male housing 10 (see FIG. 8) while the lock 35 passes above the engaging portion 14, as shown in FIG. 12.

As described above, the unlocking arm 40 can be inclined like a seesaw and is separate from the lock arm 33. Additionally, the lock 35 of the lock arm 33 is pushed up by the lever action of the unlocking arm 40, thereby canceling the locked state. Thus, unlocking can be carried out smoothly and securely while increasing the locking force by thickening the base ends 36 of the lock arm 33 to enhance the rigidity thereof. The fulcrums 42 of the unlocking arm 40 can be narrowed to a necessary and minimum extent, so that the unlocking arm 40 can be inclined with a small force.

The lock 35 of the lock arm 33 and the front frame piece 45 of the unlocking arm 40 are separate. As described above, the lock arm 33 inclines as the housings 10, 20 are connected by inclining the lock arm 33. The lock arm 33 then is restored resiliently to lock the housings 10, 20 together. Additionally, a hitting sound or clicking feeling is made as the lock 35 hits the upper surface of the male housing 10 behind the engaging portion 14.

The lock 35 of the lock arm 33 and the front frame piece 45 of the unlocking arm 40 could be coupled integrally. In this situation, the unlocking arm 40 would pull the lock arm 33 if the lock arm 33 tries to return after proper connection of the housings 10, 20. This reduces a force of the lock 35 to hit the upper surface of the mating male housing 10, and a hitting sound may be softer or no clicking feeling may be obtained.

However, the lock 35 of the lock arm 33 and the front frame piece 45 of the unlocking arm 40 are separate, as described above. Thus, only the lock arm 33 is inclined as the housings 10, 20 are connected, and only the lock arm 33 returns when the housings 10, 20 are connected properly. Therefore, the lock 35 will hit the upper surface of the mating male housing 10 with force, and will give a loud hitting sound and a secure clicking feeling.

The unlocking pieces 49 of the unlocking arm 40 lift the projecting pieces 48 at positions close to the leading end of the lock arm 33. Thus, the lever action is utilized more effectively and the unlocking can be effected by a smaller operation force.

A second embodiment of the invention is described with reference to FIGS. 13 to 24. The locking and unlocking constructions in the second embodiment differ from those the first embodiment, and these differences are described below. Parts of a male housing 10A and a female housing 20A that have the same functions as the first embodiment are described only briefly or are not described at all, but are identified with the same reference numerals.

Figure 13:
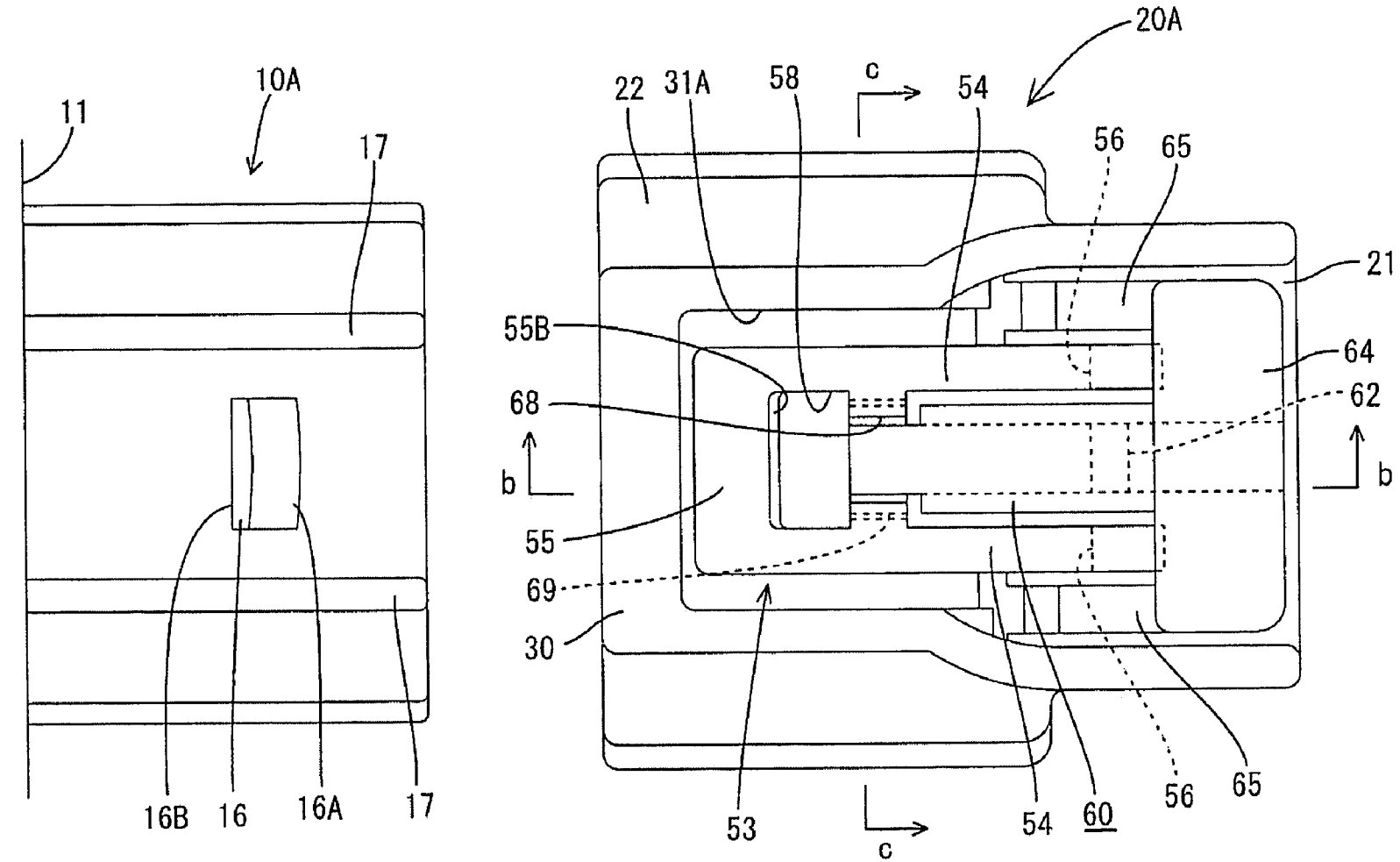
FIG. 13 is a plan view showing a state before male and female housings according to a second embodiment of the invention are connected.
Figure 14:
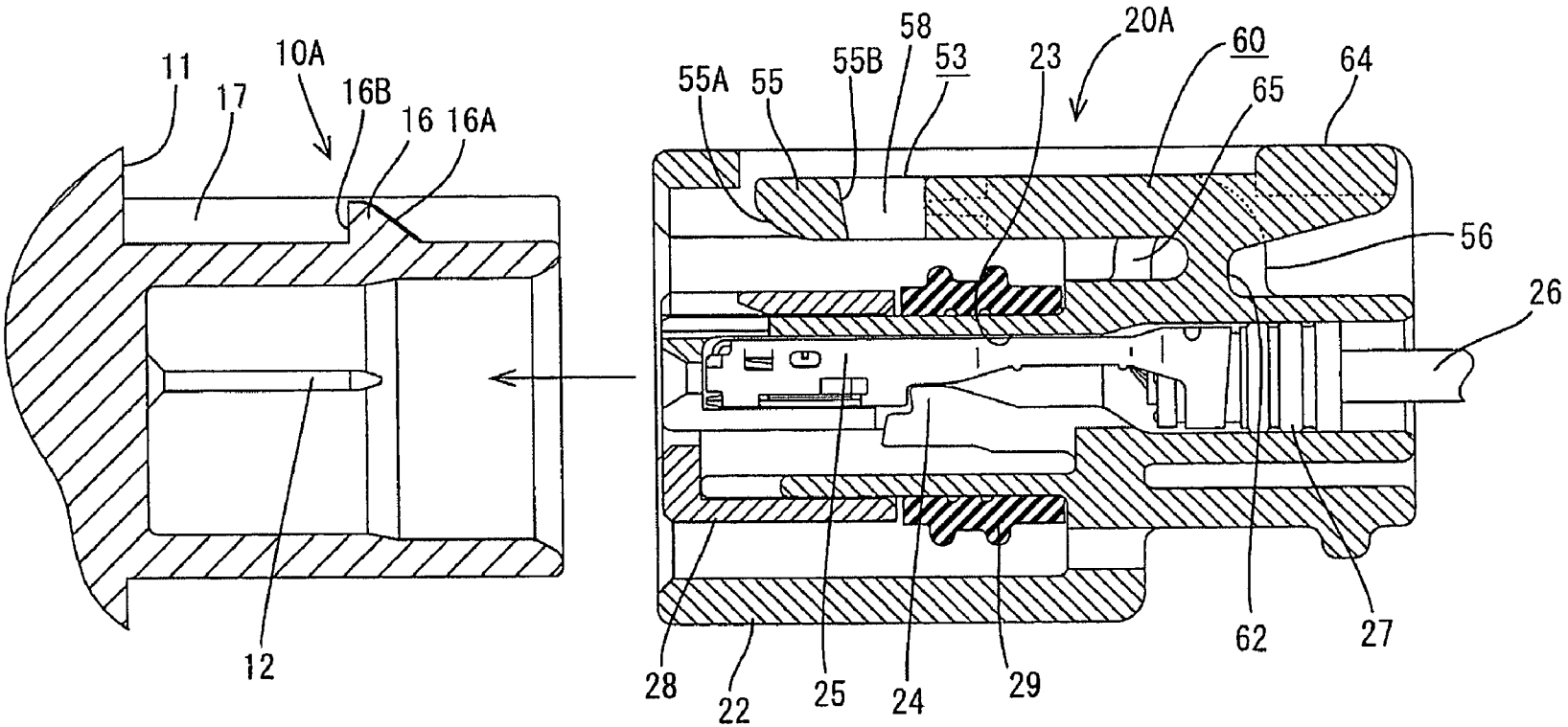
FIG. 14 is a longitudinal section showing the state of FIG. 13.
Figure 15:
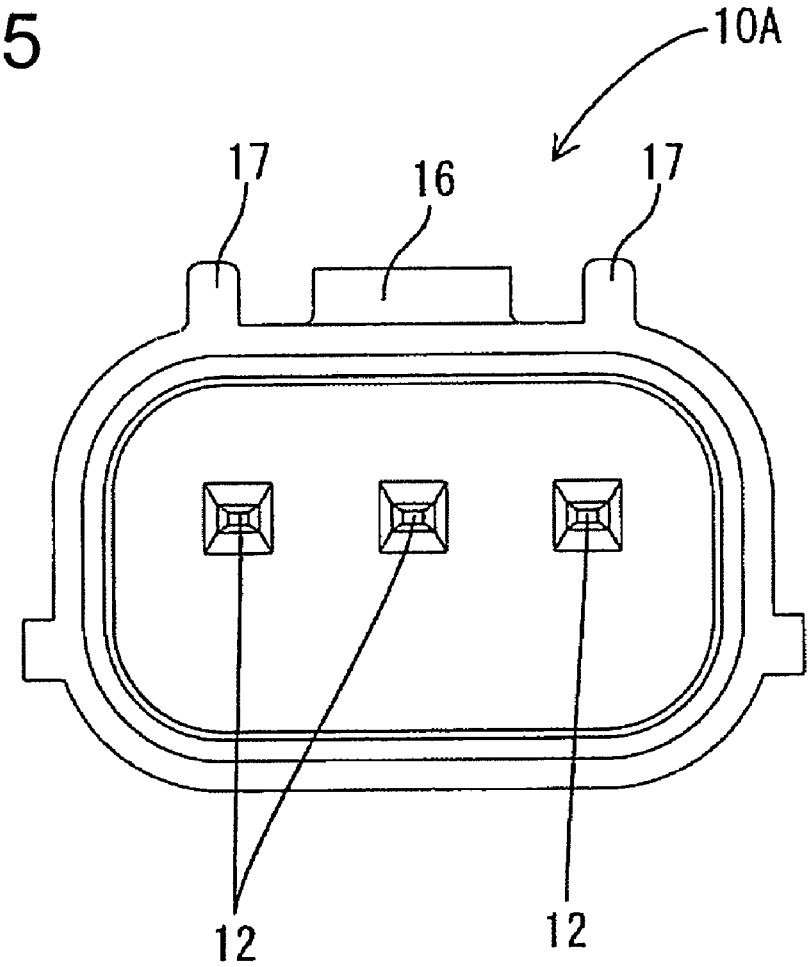
FIG. 15 is a front view of the male housing.
Figure 16:
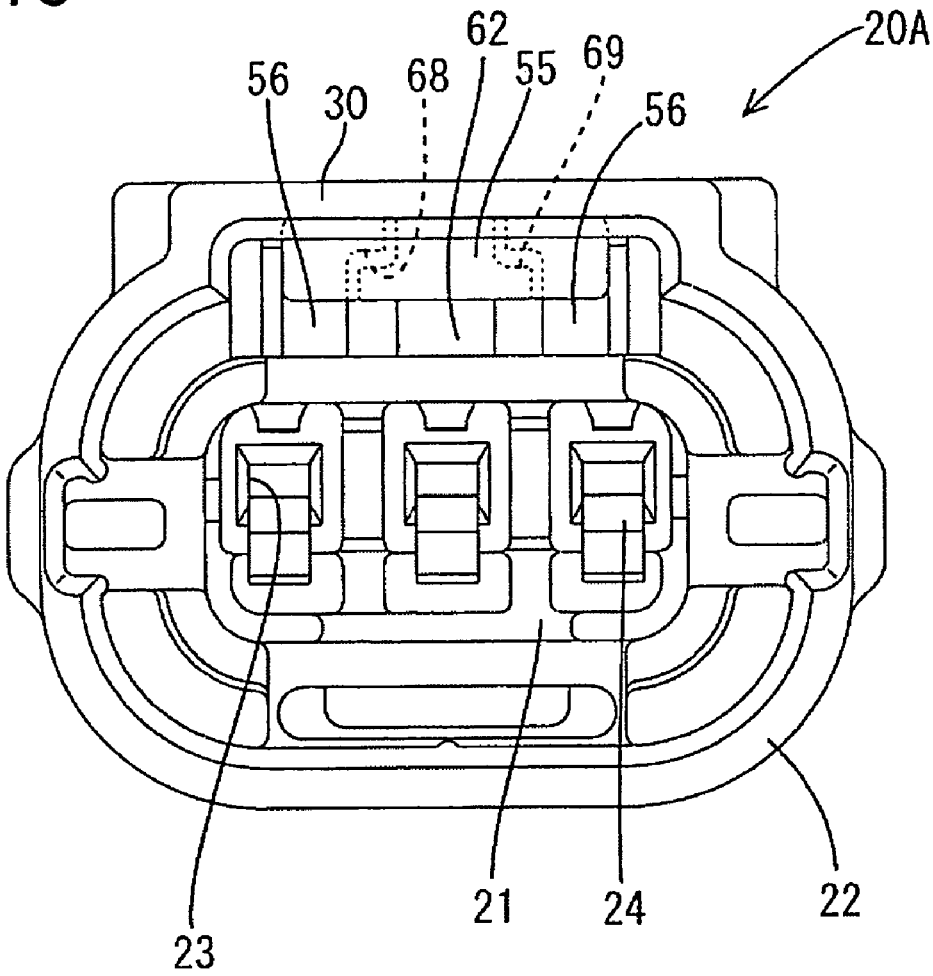
FIG. 16 is a front view of the female housing.
Figure 17:
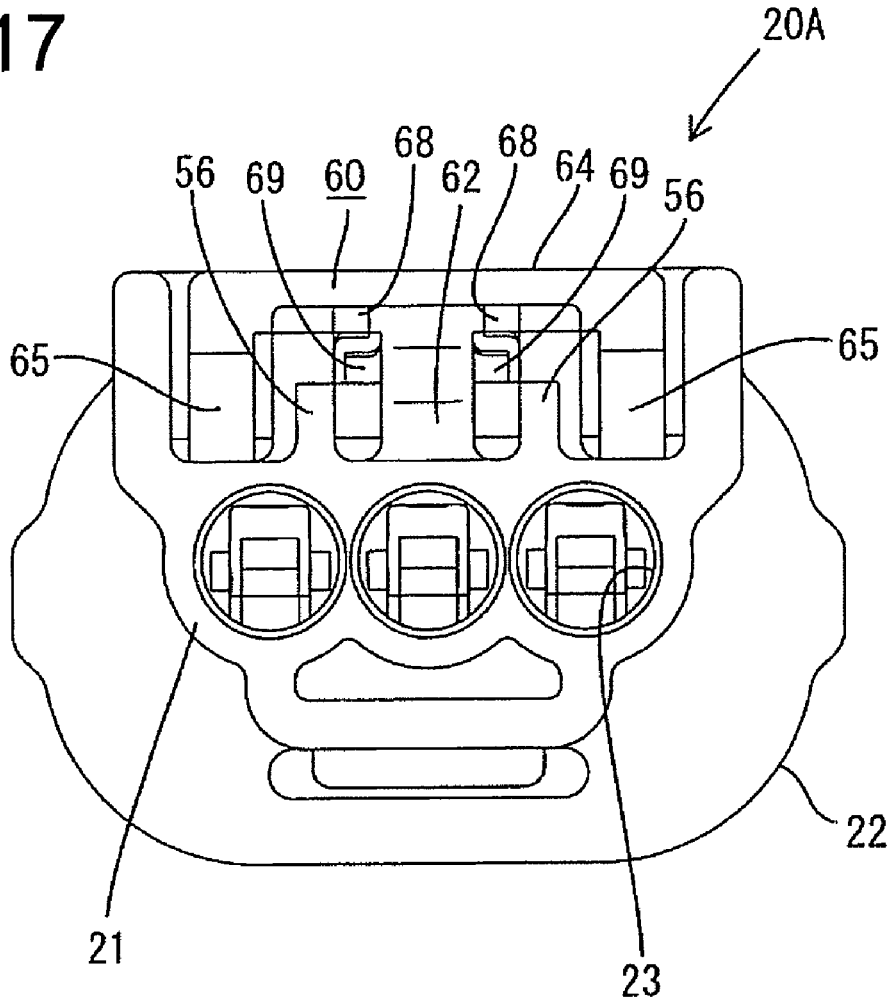
FIG. 17 is a rear view of the female housing.

In FIGS. 13 and 14, an engaging portion 16 is formed on the upper surface of the male housing 10A to project at a position in the widthwise center and slightly forward from a middle position along forward and backward directions. A slanted guiding surface 16A is defined at the front of the engaging portion 16, whereas a vertical engaging surface 16B is at the rear. The engaging portion 16 is slightly under three times as wide as the engaging portion 14 of the first embodiment. Guiding walls 17 are formed over the entire length at the opposite sides of the engaging portion 16.

The female housing 20A has an arched portion 30 with a window hole 30 and a lock arm 53 is provided in the window hole 31A. The lock arm 53 has a pair of arms 54 and leading ends of the arms 54 are coupled by a lock 55. The arms 54 are larger at the back side and have thick base ends 56 that stand up unitarily from the upper surface of a terminal accommodating portion 21 at positions behind the rear surface of a receptacle 22. The base ends 56 are bent to extend forward. The two arms 54 extend up to a position a little before the front edge of the window hole 31A while being held parallel at a spacing slightly larger than the width of the engaging portion 16 of the male housing 10A. A rounded guiding surface 55A is formed at the bottom end of the front surface of the lock 55. The lock arm 53 is fittable into a space defined between the guiding walls 17 of the male housing 10A.

The lock arm 53 is cantilevered forward from the upper surface of the terminal accommodating portion 21 and can be inclined resiliently up and down about the base ends 56 to lift a front side thereof. A locking groove 58 is formed between the two arms 54 for receiving the engaging portion 16 of the male housing 10A. A locking surface 55B is defined on the rear surface of the lock 55 and faces into the front of the locking groove 58. The locking surface 55B will face the engaging surface 16B of the engaging portion 16.

Figure 18:
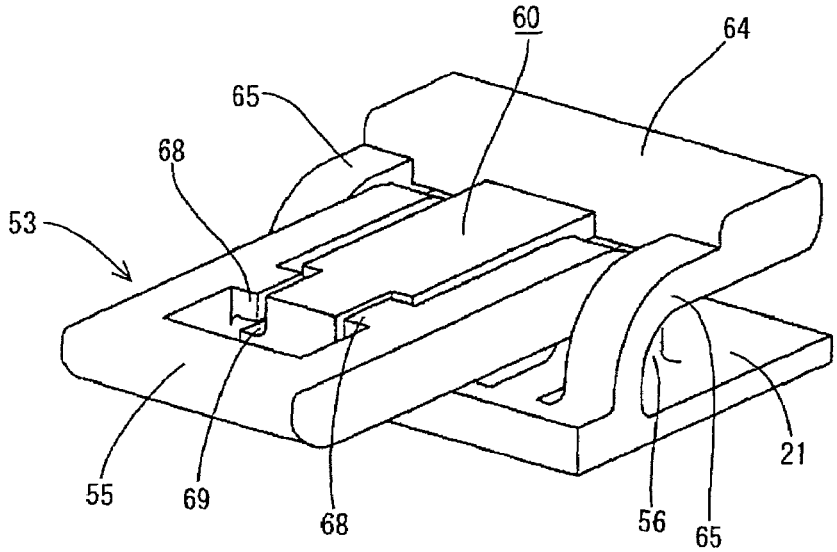
FIG. 18 is a perspective view of a locking mechanism of the female housing.

A long narrow unlocking arm 60 is provided separately from the lock arm 53 in the window hole 31A of the female housing 20 for canceling the locking by the lock arm 53. As shown in FIG. 18, the unlocking arm 60 has fits in the locking groove 58 of the lock arm 53. A fulcrum 62 is at an intermediate position of the lower surface of the unlocking arm 60 along the longitudinal direction and is coupled to the upper surface of the terminal accommodating portion 21, as shown in FIG. 14. The fulcrum 62 aligns with the front halves of the base ends 56 of the lock arm 53.

The front end of the unlocking arm 60 is before the front edge of the locking groove 58 and leaves a space for receiving the engaging portion 16. The rear end of the unlocking arm 60 is near the rear surface of the terminal accommodating portion 21. A wide plate-shaped operable portion 64 is mounted horizontally on the upper surface of the rear end of the unlocking arm 60. Opposite ends of the operable portion 64 are coupled to and supported by leg pieces 65 that stand up from the upper surface of the terminal accommodating portion 21 and curve backward. Accordingly, the operable portion 64 can be pressed down to incline the unlocking arm 60 resiliently about the fulcrum 62 to bend the leg pieces 65 and to lift the front end of the unlocking arm 65.

Figure 19:
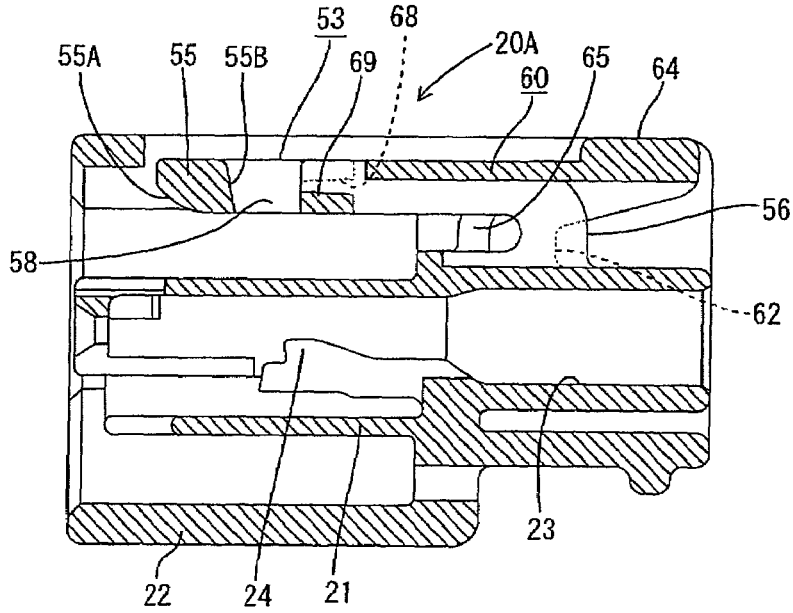
FIG. 19 is a section along a—a of FIG. 13.
Figure 20:
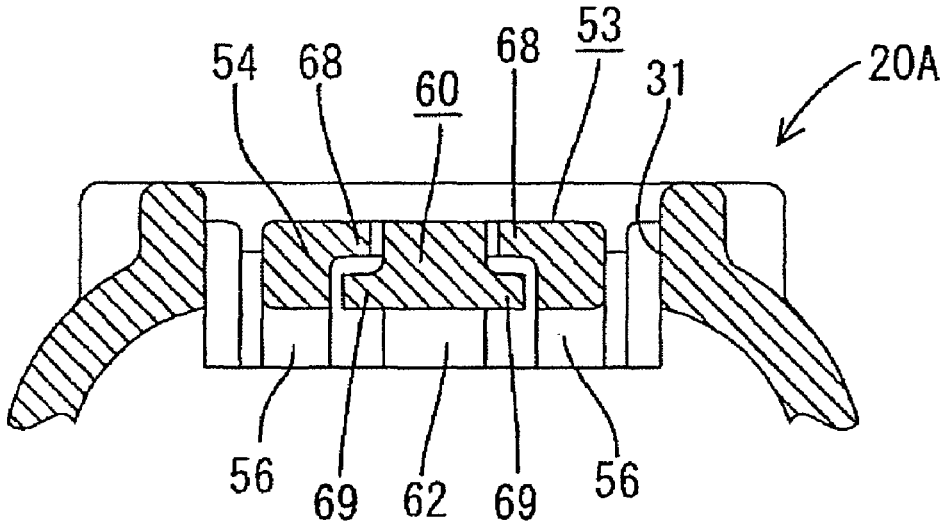
FIG. 20 is a section along c—c of FIG. 13.

As shown in FIGS. 19 and 20, projecting pieces 68 are formed on the opposite side surfaces of the locking groove 58 of the lock arm 53 and bulge out along the front end of the unlocking arm 60 in substantially upper halves of areas along the thickness direction. On the other hand, unlocking pieces 69 are formed on the left and right surfaces of the front end of the unlocking arm 60 and bulge out in substantially lower half areas along thickness direction. The unlocking pieces 69 slip under the corresponding projecting pieces 68.

Figure 21:
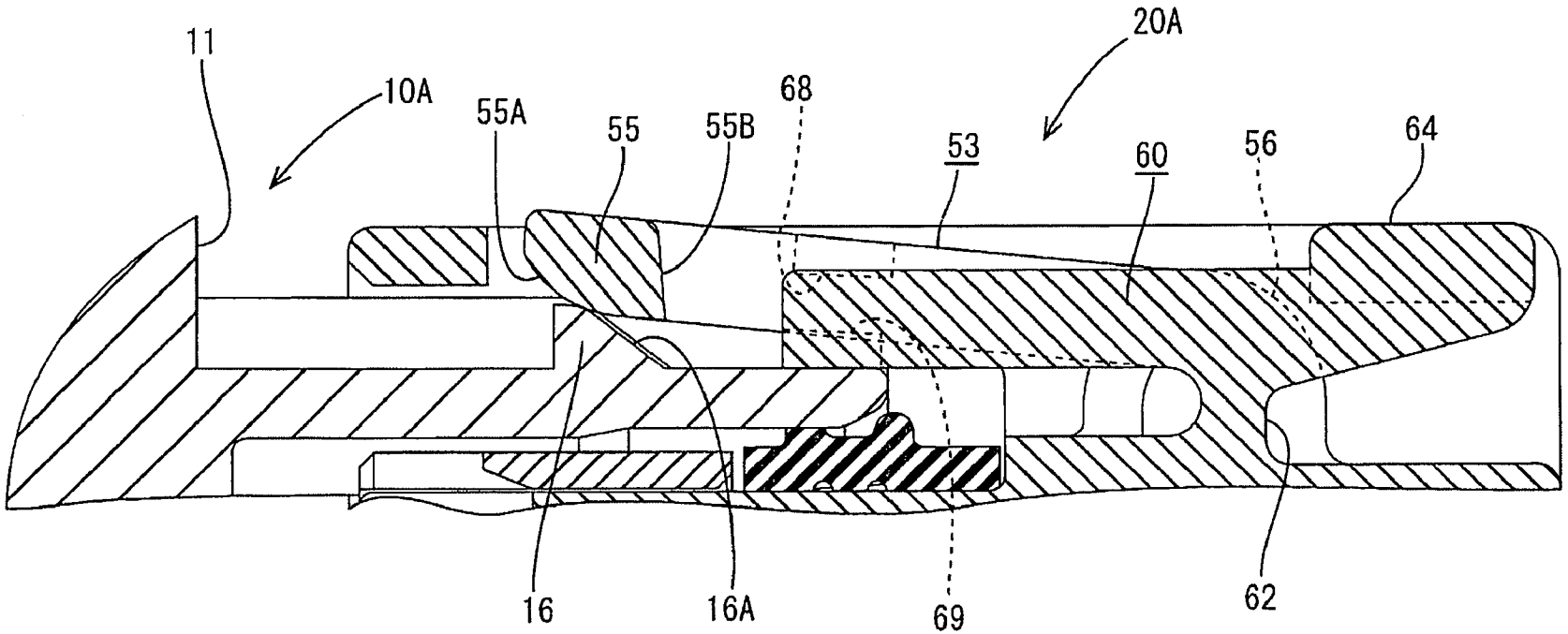
FIG. 21 is a partial longitudinal section showing an intermediate stage of connection.

The female terminals 25 are mounted into the female housing 20A and the female housing 20A is connected with the male housing 10A, as shown by an arrow in FIG. 14. The female housing 20A to move the lock arm 53 along the inner sides of the two guiding walls 17. The engaging portion 16 then enters the locking groove 58 and the guiding surface 16A contacts the guiding surface 55A of the lock 55 of the lock arm 53. As a result, the lock 55 moves onto the engaging portion 16 and the lock arm 53 inclines resiliently about the base ends 56, as shown in FIG. 21. The projecting pieces 68 escape up from the unlocking pieces 69 when the lock arm 53 is inclined. Thus, only the lock arm 53 is inclined and the unlocking arm 60 remains at its initial position.

Figure 22:
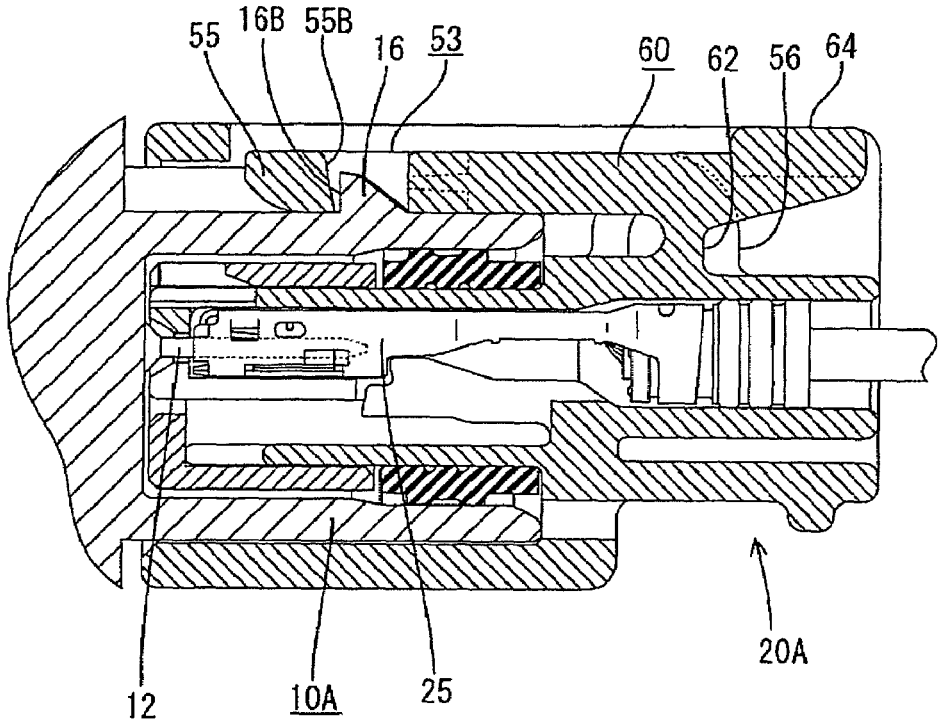
FIG. 22 is a longitudinal section showing complete connection.
Figure 23:
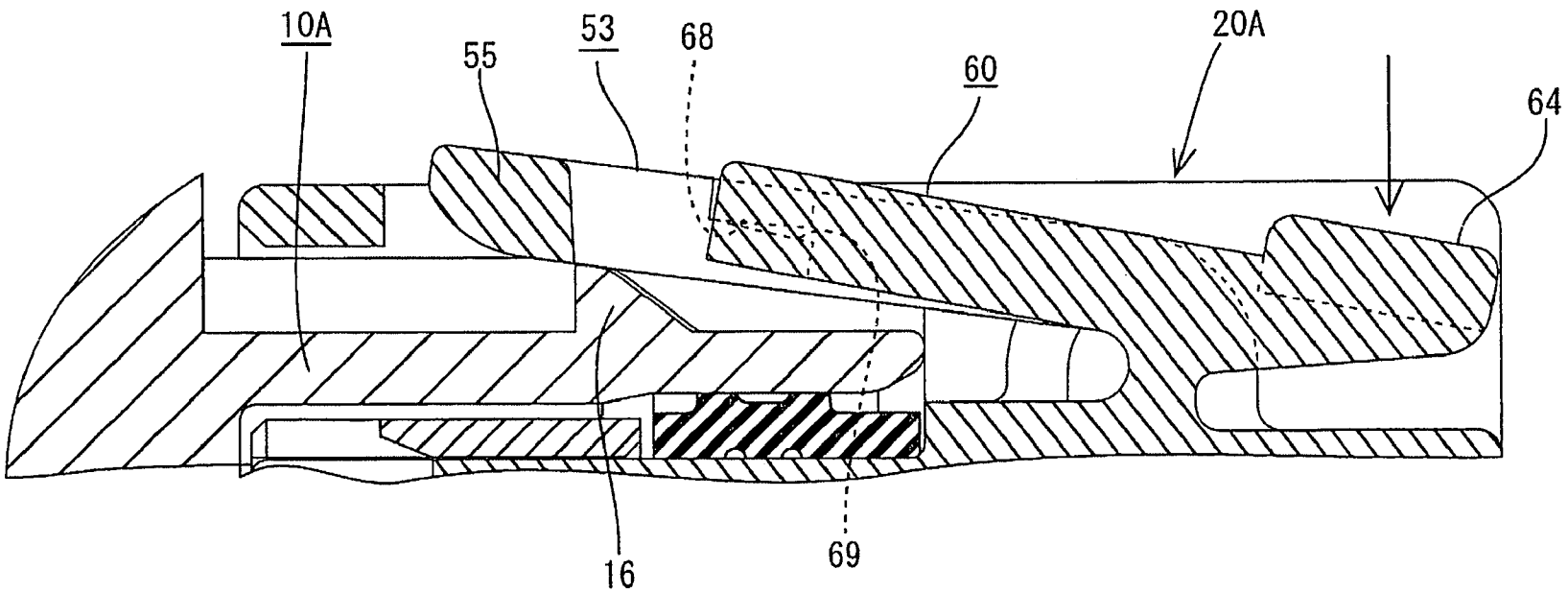
FIG. 23 is a partial longitudinal section showing a state where an unlocking arm is pressed.

The lock 55 passes the engaging portion 16 when the female housing 20A is connected to a proper position. As a result, the lock arm 53 is restored so that the engaging portion 16 fits into the locking groove 58 and the engaging surface 16B engages the locking surface 55B, as shown in FIG. 22. Thus, the two housings 10A, 20A are locked in their properly connected state.

Figure 24:
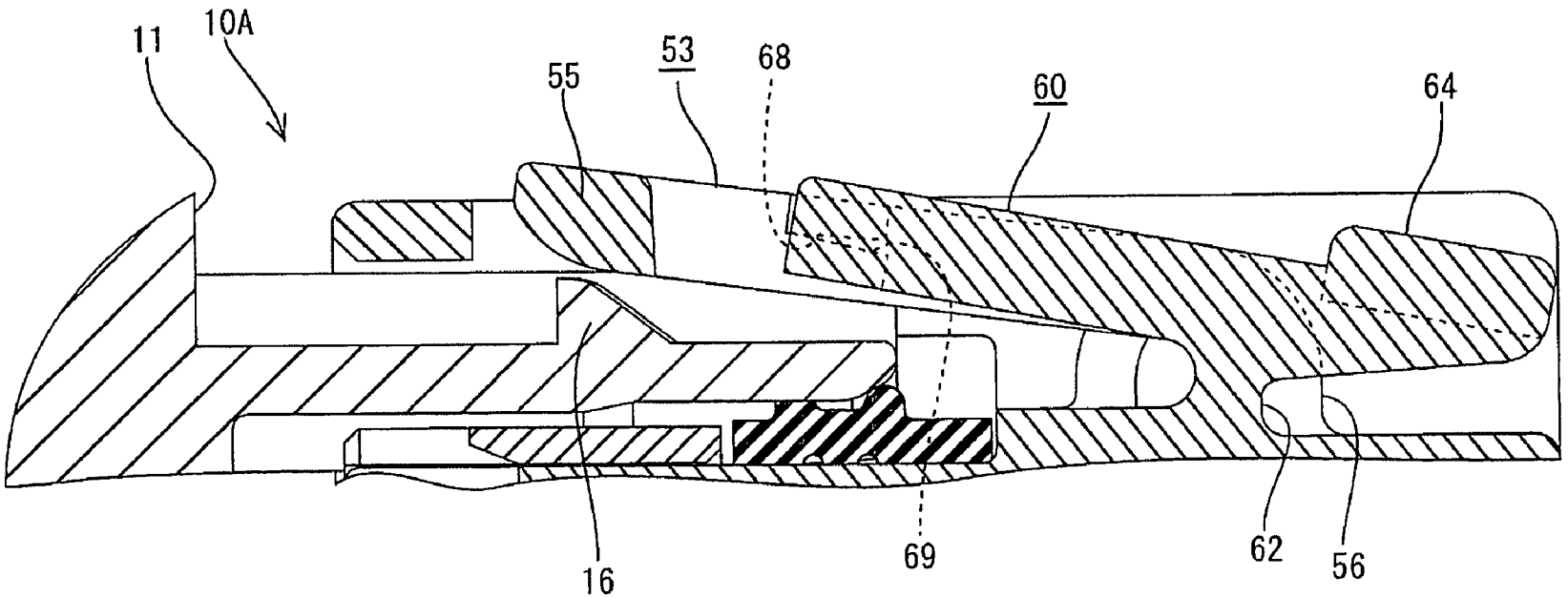
FIG. 24 is a partial longitudinal section showing an intermediate stage of separation.

The two housings 10A, 20A may require separation. Thus, the operable portion 64 of the unlocking arm 60 is pressed as shown by an arrow in FIG. 23 from a state shown in FIG. 22, thereby inclining the unlocking arm 60 and lifting the front end thereof. Thus, the unlocking pieces 69 push the projecting pieces 68 up to move the lock 55 of the lock arm 53 up and out of engagement with the engaging portion 16. The female housing 20A is pulled back in this state and out of the male housing 10A (see FIG. 14) while the lock 55 passes above the engaging portion 16 as shown in FIG. 24.

The unlocking arm 60 is separate from the lock arm 53, and the lock 55 of the lock arm 53 is pushed up by the lever action generated by inclining the unlocking arm 60 to cancel the locked state. Thus, unlocking can be carried out smoothly and securely while increasing the locking strength by thickening the base ends 56 of the lock arm 53 and enhancing the rigidity. The unlocking arm 60 can be inclined with a small force by narrowing the fulcrum 62 of the unlocking arm 60 to a necessary and minimum extent.

The lock 55 of the lock arm 53 and the front end of the unlocking arm 60 are separated. Thus, only the lock arm 53 inclines as the housings 10A, 20A are connected and only the lock arm 53 returns when the housings 10A, 20A are connected properly. Thus, the lock 55 can hit the upper surface of the mating male housing 10A with force, thereby making a loud hitting sound or a clicking feeling. In other words, a stable lock feeling can be obtained.

The leading end of the lock arm 53 is a frame that surrounds the front end of the unlocking arm 60. Thus, the lock arm 53 can have a wide lock 55. The engaging portion 16 on the male housing 10A also is wider. Thus, a larger area of engagement can be ensured to enhance the locking strength.

FIGS. 25 to 35 show a third embodiment of the invention. In this third embodiment, the locking and unlocking constructions are changed further and this change is described below. Parts of a male housing 10B and a female housing 20B that have the same functions as those of the first and second embodiments are described only briefly or not at all, but are identified with the same reference numerals.

Figure 25:
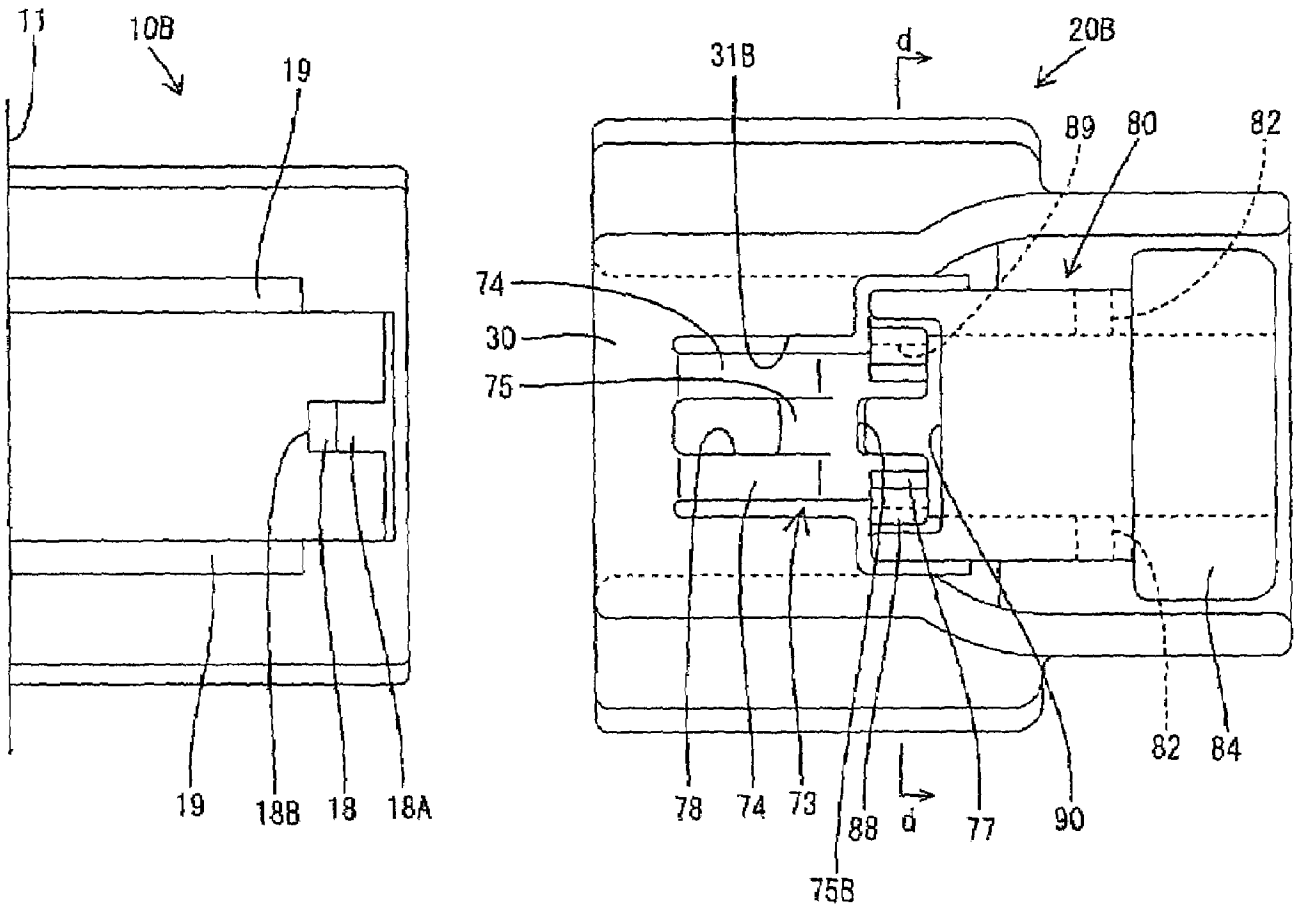
FIG. 25 is a plan view showing a state before a male and a female housings according to a third embodiment of the invention are connected.
Figure 26:
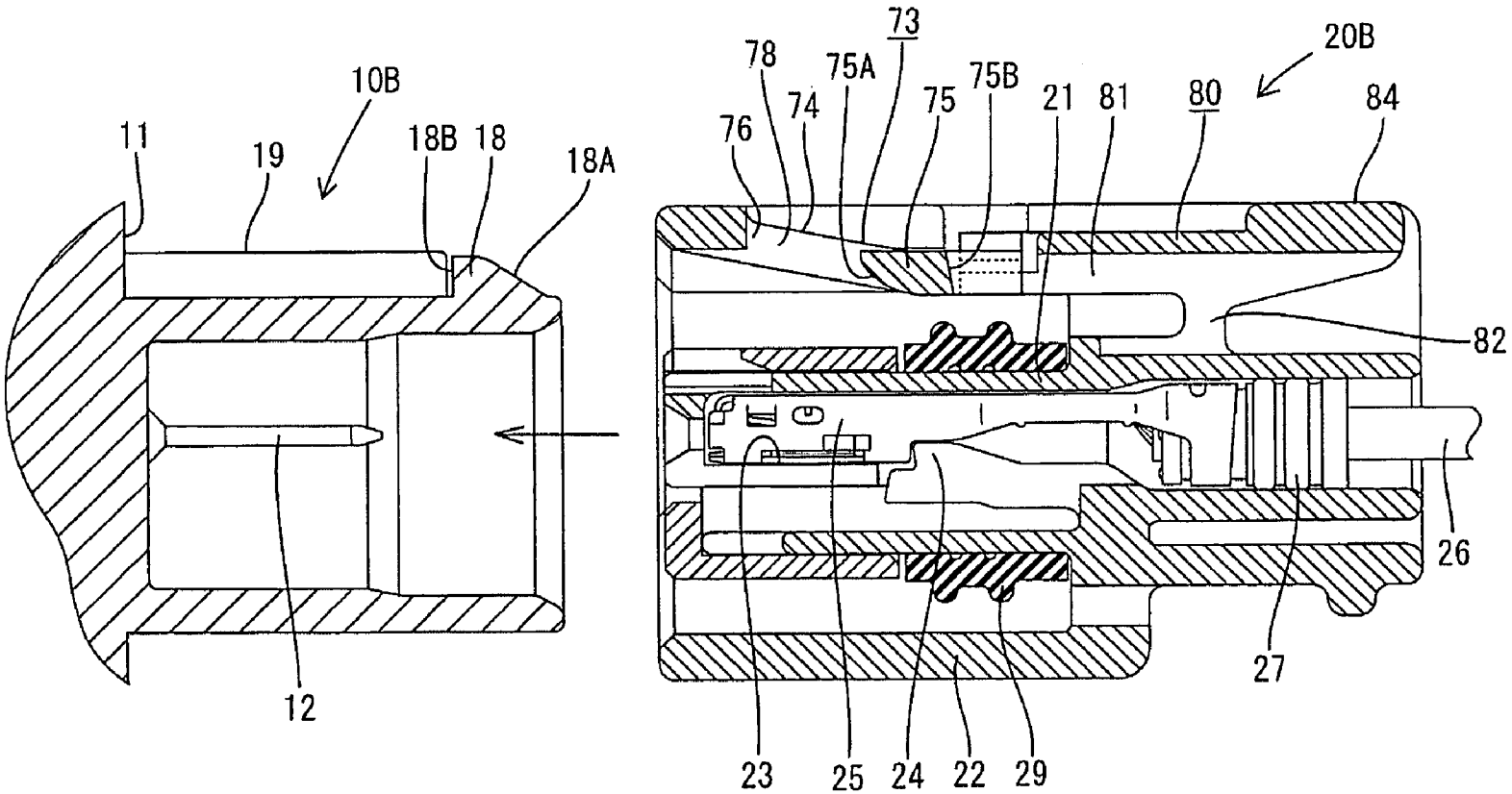
FIG. 26 is a longitudinal section showing the state of FIG. 25.
Figure 27:
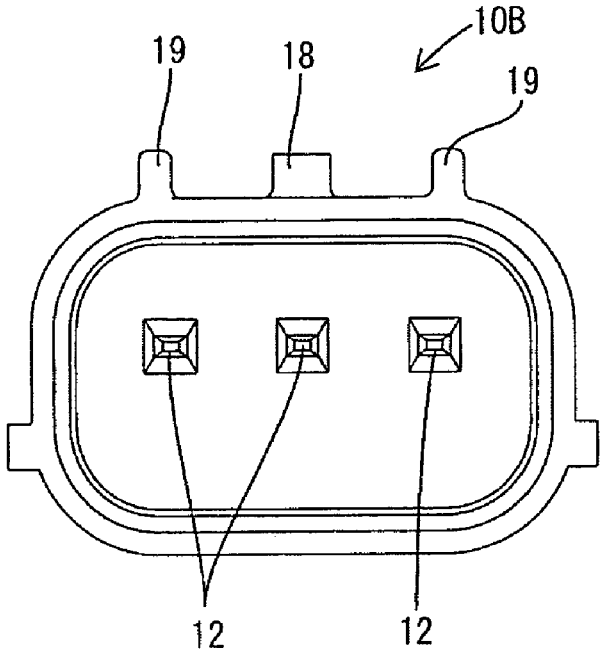
FIG. 27 is a front view of the male housing.
Figure 28:
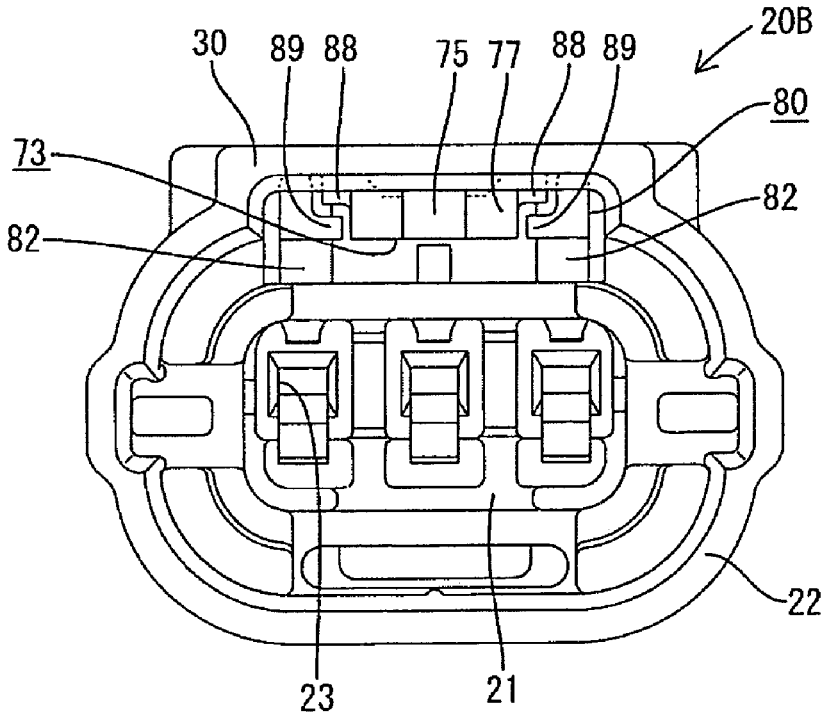
FIG. 28 is a front view of the female housing.
Figure 29:
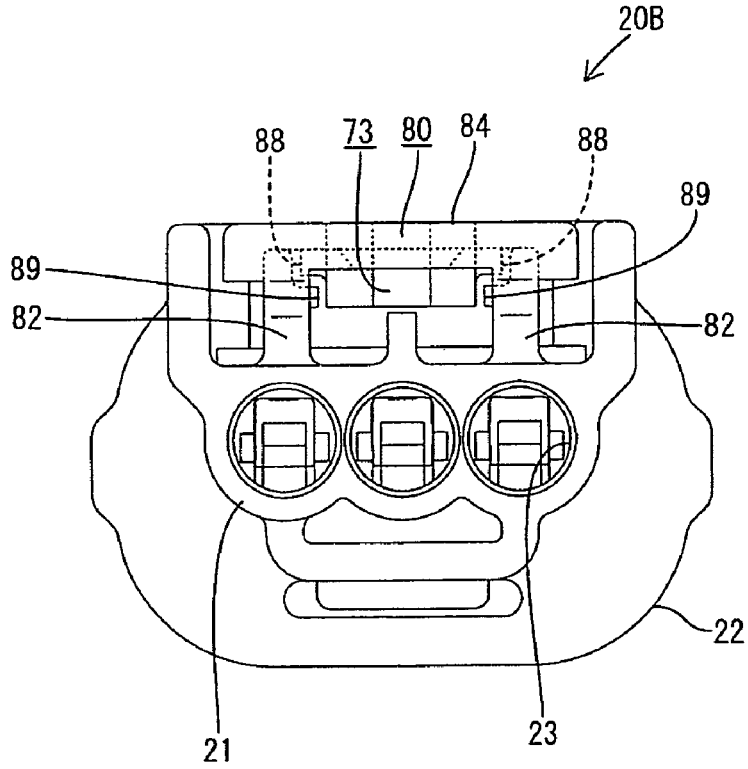
FIG. 29 is a rear view of the female housing.

In FIGS. 25 and 26, an engaging portion 18 is formed at a position in the widthwise center and very close to the front end on the upper surface of the male housing 10B. The engaging portion 18 is as narrow as in the first embodiment. A guiding surface 18A is defined at the front of the engaging portion 18 and a vertical engaging surface 18B is at the rear. Guiding walls 19 are formed at opposite sides of the engaging portion 18, but extend only in an area behind the engaging portion 18. The guiding walls 19 fit inside the side walls of an arched portion 30 of the female housing 20B.

The female housing 20 has an arched portion 30, and a window hole 31B with an open rear end is formed in the arched portion 30 of the female housing 20 except the front part thereof. The window hole 31B has a stepped configuration with a narrower front end and a wider rear end. A lock arm 73 is provided in the window hole 31B. The lock arm 73 has a pair of arms 74 and a lock 75 that couples leading ends of the arms 74. Unlike the first and second embodiments, the arms 74 are relatively short and extend back with respect to a connecting direction with the mating male housing 10B. More specifically, the relatively short arms 74 extend obliquely back from the front edge of the narrower part of the window hole 31B and are held parallel at a spacing slightly wider than the width of the engaging portion 18 of the male housing 10B. The lock 75 is coupled between the extending ends of the arms 74. A locking surface 75B is formed in the widthwise middle of the rear surface (right surface in FIG. 26) of the lock 75 and is engageable with the engaging surface 18B of the engaging portion 18. An escaping groove 78 is defined between the arms 74 for receiving the engaging portion 18, and a surface of the lock 75 opposite from the locking surface 75B and exposed to the escaping groove 78 has a bottom end rounded to form a guiding surface 75B. The lock arm 73 can be inclined resiliently about the base ends 76 to displace the leading ends of the arms 74 along the vertical direction.

Figure 30:
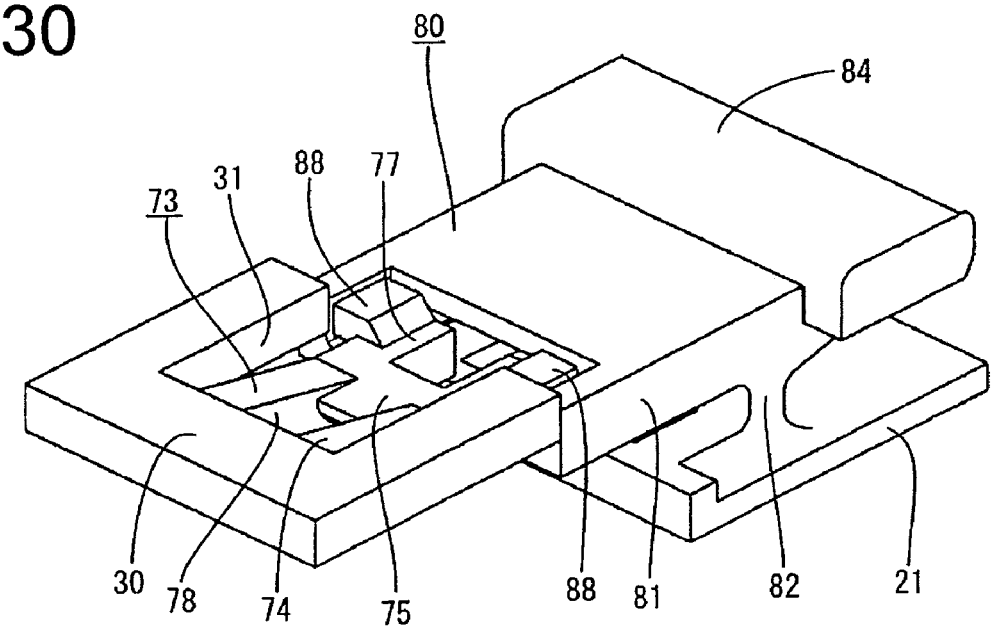
FIG. 30 is a perspective view of a locking mechanism of the female housing.

An unlocking arm 80 is provided separately from the lock arm 73 in the window hole 31B of the female housing 20B for canceling the locking by the lock arm 73. The unlocking arm 80 is formed with a wide shallow channel that faces down and extends forward and backward, as shown in FIG. 30. Left and right arms 81 extend along longitudinal directions and are coupled to the upper surface of the terminal accommodating portion 21 by fulcrums 82 at intermediate positions of the lower surfaces of left and right walls 81. The fulcrums 82 are at positions behind the rear surface of the receptacle 22.

The front end of the unlocking arm 80 abuts the leading end of the lock arm 73, and the rear end of the unlocking arm 80 is near the rear of the terminal accommodating portion 21. A wide plate-shaped operable portion 84 extends transversely on the upper surface of the rear end of the unlocking arm 80. Accordingly, the operable portion 84 can be pressed to incline the unlocking arm 80 resiliently about the fulcrums 82 to lift the front end thereof.

Figure 31:
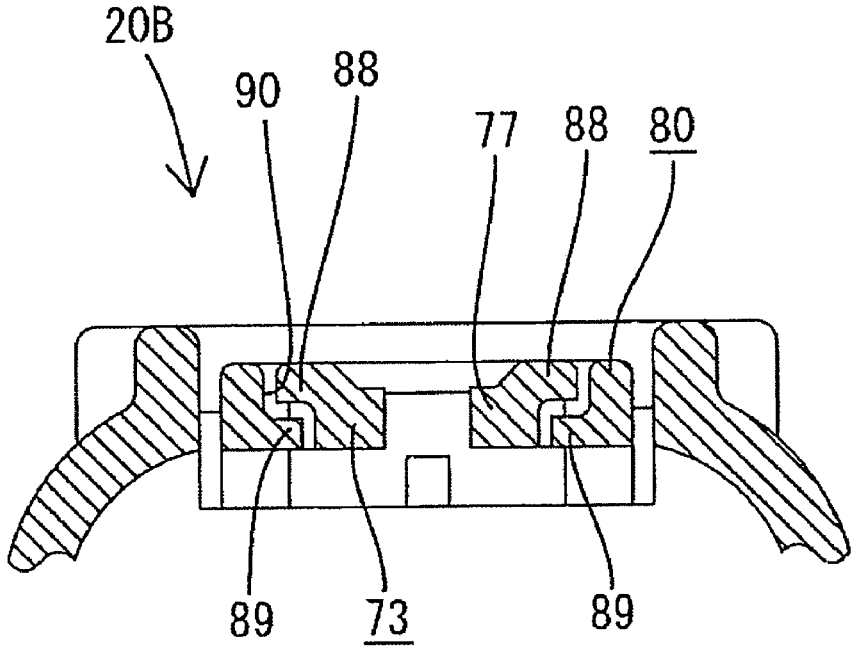
FIG. 31 is a section along d—d of FIG. 25.

Projections 77 are formed on the rear surface of the lock 75 of the lock arm 73 and project back from the opposite sides of the locking surface 75B. Projecting pieces 88 bulge out from the outer side surfaces of both projections 77 at slightly higher positions as shown in FIG. 31.

A recess 90 is formed at the front end of the unlocking arm 80 for receiving the projections 77 of the lock arm 73 including the projecting pieces 88. Unlocking pieces 89 bulge out from the bottom ends of the left and right walls of the recess 90 and slip under the respective projecting pieces 88.

Figure 32:
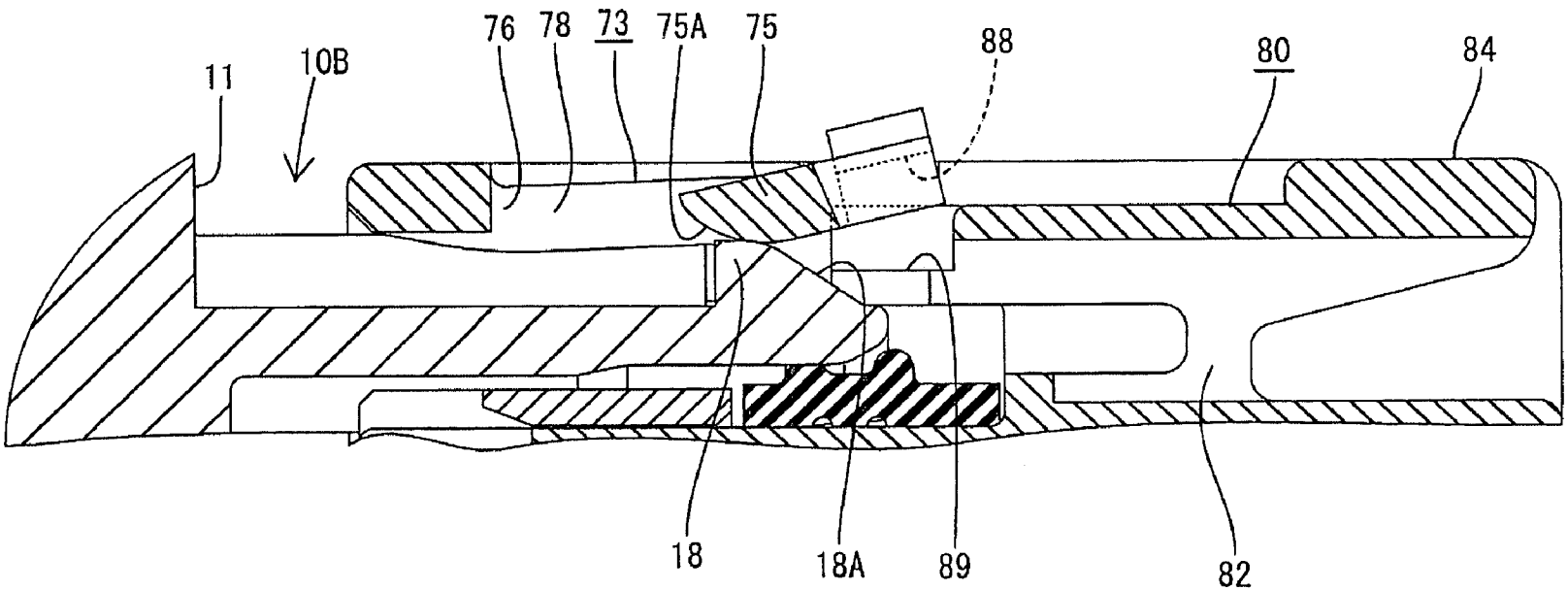
FIG. 32 is a partial longitudinal section showing an intermediate stage of connection.

The female terminals 25 are fit into the female housing 20B and the female housing 20B is connected with the male housing 10B as shown by an arrow in FIG. 26. The female housing 20B is connected to move the left and right walls of the arched portion 30 along the outer sides of the two guiding walls 19. The engaging portion 18 then enters the escaping groove 78 of the lock arm 73 and the guiding surface 18A contacts the locking surface 75A of the lock 75 of the lock arm 73. Thus, the lock 75 moves onto the engaging portion 18 and the lock arm 73 inclines resiliently about the base ends 76, as shown in FIG. 32. Only the projecting pieces 88 escape up from the unlocking pieces 89 when the lock arm 73 is inclined. Thus, the lock arm 73 is inclined and the unlocking arm 80 is left at its initial position.

The lock 75 passes the engaging portion 18 when the female housing 20B is connected to a proper position. The lock arm 73 then restores to its initial posture and the locking surface 75B of the lock 75 engages the rear engaging surface 18B of the engaging portion 18 so that the housings 10B, 20B are locked in their properly connected state.

Figure 33:
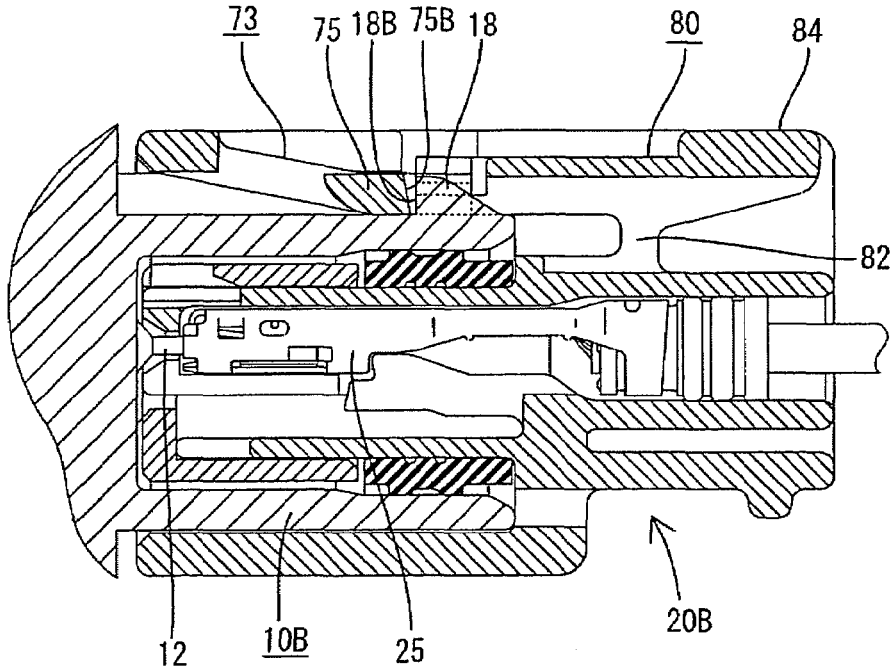
FIG. 33 is a longitudinal section showing complete connection.
Figure 34:
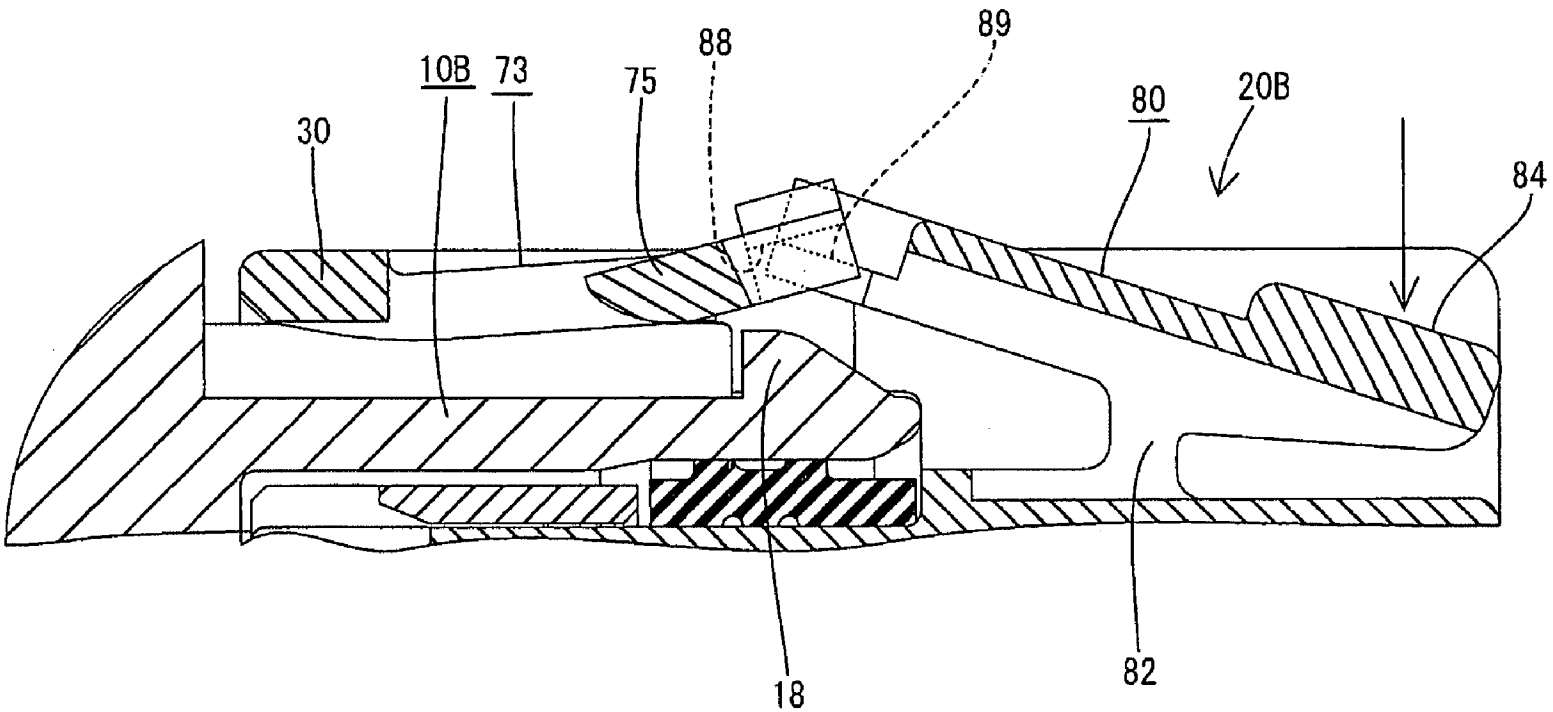
FIG. 34 is a partial longitudinal section showing a state where an unlocking arm is pressed.
Figure 35:
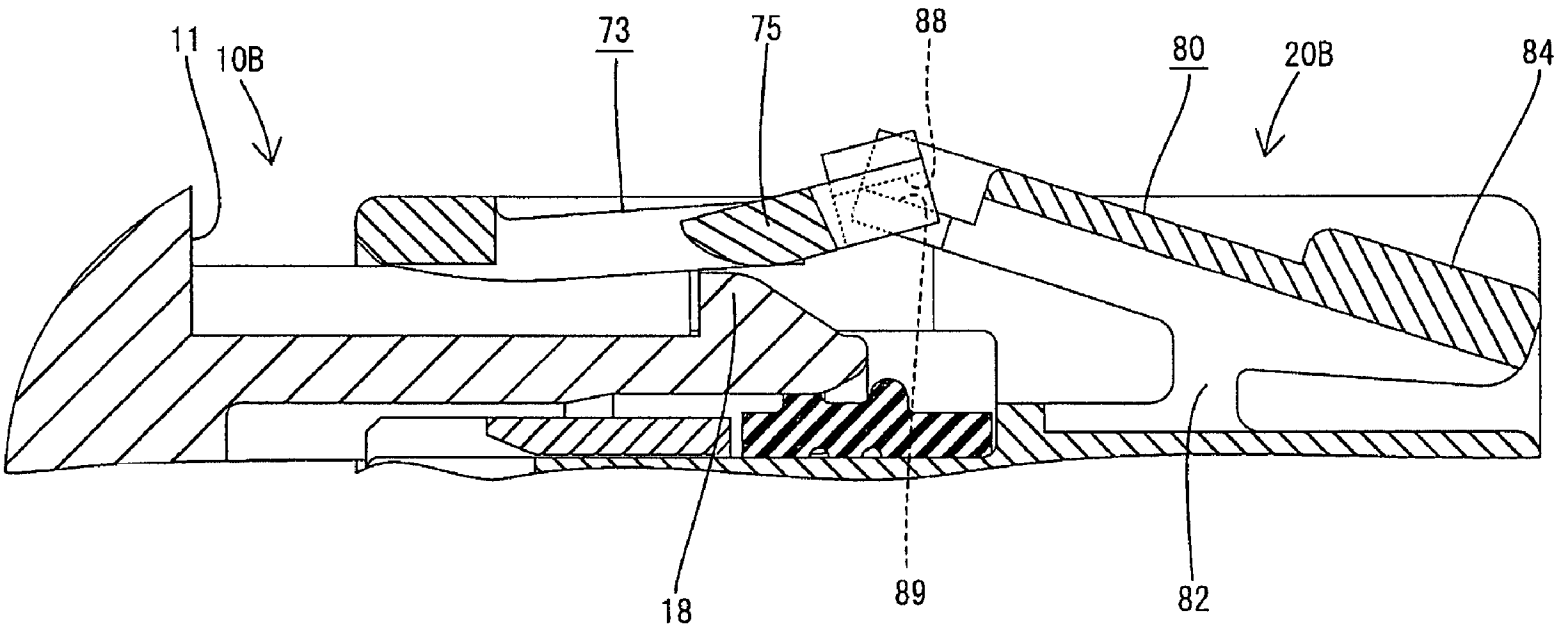
FIG. 35 is a partial longitudinal section showing an intermediate stage of separation.
Figure 36:
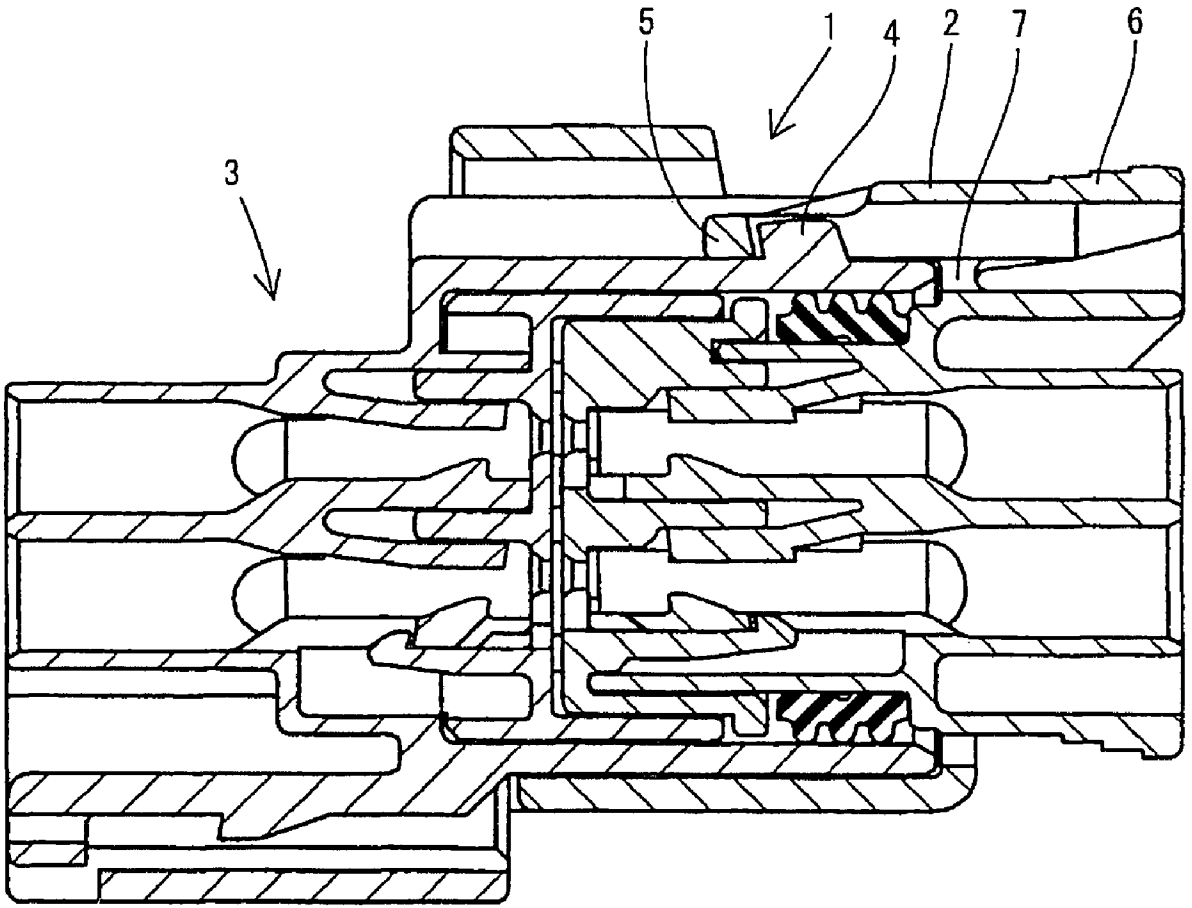
FIG. 36 PRIOR ART
FIG. 36 is a longitudinal section of a prior art connector.

The housings 10B, 20B can be separated by pressing the operable portion 84 of the unlocking arm 80 down as shown by an arrow in FIG. 34 from a state shown in FIG. 33. Thus, the unlocking arm 80 is inclined to lift the front end of the unlocking arm 80. The unlocking pieces 89 then push the projecting pieces 88 up and move the lock 75 of the lock arm 73 up. In this way, the lock 75 is disengaged from the engaging portion 18. The female housing 20B then is pulled back and out of the male housing 10B (see FIG. 26) while the lock 75 passes above the engaging portion 18, as shown in FIG. 35.

In the third embodiment as well, the unlocking arm 80 can be inclined like a seesaw and is provided separately from the lock arm 73. The lock 75 of the lock arm 73 is pushed up by the lever action generated by inclining the unlocking arm 80, thereby canceling the locked state. Thus, unlocking can be carried out smoothly and securely while increasing the locking force by the relatively short lock arm 73 that extends directly from the front edge of the window hole 31B of the arched portion 30 to enhance the rigidity. The unlocking arm 80 can be inclined with a small force by narrowing the fulcrum portion 82 of the unlocking arm 80 to a necessary and minimum extent.

The lock 75 of the lock arm 73 and the front end of the unlocking arm 80 are separate. Thus, only the lock arm 73 is inclined as the two housings 10B, 20B are connected and only the lock arm 73 returns when the two housings 10B, 20B are connected properly. The lock 75 can hit the upper surface of the mating male housing 10B with force, thereby making a loud hitting sound or providing a clicking feeling.

The lock arm 73 of the third embodiment extends back with respect to the connecting direction. Thus, the lock arm 73 successively moves onto the mating engaging portion 18 from the base end toward the leading end thereof when the two housings 10, 20 are connected. Therefore, a counteracting force from the lock arm 73 gradually decreases as the connection progresses. Accordingly, the connecting operation can be carried out smoothly carried with less feeling of resistance.

The invention is not limited to the above described and illustrated embodiments. For example, the following embodiment is also embraced by the technical scope of the present invention as defined by the claims. Beside the following embodiment, various changes can be made without departing from the scope and spirit of the present invention as defined by the claims.

Although the lock arm and the unlocking arm are provided in the female housing in the foregoing embodiments, both arms may be provided in the male housing.

The invention is not limited to connectors directly coupled to apparatuses and is similarly applicable to wire-to-wire connectors.

The invention is similarly applicable to nonwatertight connectors.

What is claimed is:

1. A connector locking construction, comprising:

an engaging portion on a first housing of a pair of male and female housings connectable with each other;

at least one resiliently deformable lock arm provided in a second housing that is connectable with the first housing, the lock arm having a lock engageable with the engaging portion; and a resiliently deformable unlocking arm provided in the second housing separately from the lock arm, the unlocking arm including an unlocking portion at one end of the unlocking arm and facing a portion of the lock arm, an operable portion at an opposite end of the unlocking arm and fulcrum between the ends of the unlocking arm for supporting the unlocking arm relative to the second housing;

the lock arm being resiliently deformed as the unlocking arm is deformed by operating the operable portion so that the lock can be disengaged from the engaging portion.

2. The connector locking construction of claim 1, wherein both the leading end of the lock arm and the one end of the unlocking arm extend substantially forward with respect to a connecting direction with the mating housing.

3. The connector locking construction of claim 1, wherein the one end of the unlocking arm (40) is formed into such a frame as to at least partly surround the leading end of the lock arm (33).

4. The connector locking construction of claim 3, wherein the unlocking portion (49) is formed on each of lateral frame pieces (41) of the unlocking arm (40) for engageable with a back surface of a corresponding one of lateral edges of the leading end of the lock arm (33).

5. The connector locking construction of claim 1, wherein the leading end of the lock arm is a frame that at least partly surrounds the one end of the unlocking arm.

6. The connector locking construction of claim 5, wherein the unlocking portion is formed on each of opposite lateral edges of the one end of the unlocking arm for engaging the back surface of a corresponding one of lateral frame pieces at the leading end of the lock arm.

7. The connector locking construction of claim 1, wherein the leading end of the lock arm (73) extends substantially back with respect to a connecting direction (CD) with the mating housing (10B), and the one end of the unlocking arm (80) extends substantially forward with respect to the connecting direction (CD) with the mating housing (10B) to substantially abut a leading end of the lock arm (73).

8. A connector assembly comprising a pair of male and female housings connectable with each other and the connector locking construction of claim 1.

9. A connector connectable with a mating connector, the connector having a housing comprising:

at least one resiliently deformable lock arm having a lock spaced from the housing, the lock being engageable with an engaging portion on a mating housing of the mating connector; and an unlocking arm resiliently deformable and provided on the housing separately from the lock arm, the unlocking arm including an unlocking portion at one end of the unlocking arm and disposed at least party between the housing and the lock arm and an operable portion at an opposite end of the unlocking arm, the lock arm being resiliently deformed as the unlocking arm is deformed by operating the operable portion, whereby the lock can be disengaged from the engaging portion.

10. A connector locking construction, comprising:

an engaging portion on a first housing of a pair of male and female housings connectable with each other;

at least one resiliently deformable lock arm provided in a second housing that is connectable with the first housing, the lock arm having a lock engageable with the engaging portion; and a resiliently deformable unlocking arm provided in the second housing separately from the lock arm, the unlocking arm including an unlocking portion and an operable portion;

the lock arm being resiliently deformed as the unlocking arm is deformed by operating the operable portion so that the lock can be disengaged from the engaging portion, the locking arm having a leading end defining a frame that at least partly surrounds an end of the unlocking arm having the unlocking portion.

11. The connector locking construction of claim 10, wherein the unlocking portion is formed on each of opposite lateral edges of the one end of the unlocking arm for engaging the back surface of a corresponding one of lateral frame pieces at the leading end of the lock arm.

* * * * *

UNITED STATES PATENT AND TRADEMARK OFFICE

CERTIFICATE OF CORRECTION

PATENT NO. : 7,033,201 B2 
APPLICATION NO. : 11/005338
DATED : April 25, 2006
INVENTOR(S) : Kiyofumi Ichida et al.

It is certified that error appears in the above-identified patent and that said Letters Patent is hereby corrected as shown below:

Col. 1. Title Page line 1
(30) Foreign Application Priority Data

December 5, 2003 (JP) ..... 2003-407596

Signed and Sealed this

Twenty-third Day of January, 2007

JON W. DUDAS
*Director of the United States Patent and Trademark Office*